US009278730B2

(12) United States Patent
Kaye

(10) Patent No.: US 9,278,730 B2
(45) Date of Patent: Mar. 8, 2016

(54) BRACE FOR FOLDING TRANSOM

(71) Applicant: Alex R. Kaye and Frances Kaye Trust, Atherton, CA (US)

(72) Inventor: Alex R. Kaye, Atherton, CA (US)

(73) Assignee: ALEX R. KAYE AND FRANCES KAYE TRUST, Atherton, CA (US)

( * ) Notice: Subject to any disclaimer, the term of this patent is extended or adjusted under 35 U.S.C. 154(b) by 0 days.

(21) Appl. No.: 14/135,328

(22) Filed: Dec. 19, 2013

(65) Prior Publication Data

US 2014/0102351 A1 Apr. 17, 2014

Related U.S. Application Data

(63) Continuation-in-part of application No. 13/901,254, filed on May 23, 2013, which is a continuation of application No. 13/174,577, filed on Jun. 30, 2011, now Pat. No. 8,539,900, which is a continuation-in-part of application No. 12/650,340, filed on Dec. 30, 2009, now Pat. No. 8,413,600.

(51) Int. Cl.
*B63B 7/00* (2006.01)
*B63H 20/02* (2006.01)
(Continued)

(52) U.S. Cl.
CPC . *B63B 7/00* (2013.01); *B63B 7/082* (2013.01); *B63B 29/04* (2013.01); *B63H 20/02* (2013.01); *B63B 7/085* (2013.01); *B63B 2007/003* (2013.01)

(58) Field of Classification Search
CPC ..... B63B 7/00; B63B 7/02; B63B 7/06; B63B 7/08; B63B 29/04; B63H 20/02
USPC ..... 114/345, 354; 248/640, 642
See application file for complete search history.

(56) References Cited

U.S. PATENT DOCUMENTS 2,346,081 A 4/1944 Randrup
2,830,308 A 4/1958 Green
(Continued)

FOREIGN PATENT DOCUMENTS

CN 2863634 Y 1/2007
CN 2889889 4/2007
(Continued)

OTHER PUBLICATIONS

U.S. Appl. No. 13/174,577, "Non Final Office action", Apr. 17, 2013, 8 pages.
(Continued)

*Primary Examiner* — Lars A Olson
(74) *Attorney, Agent, or Firm* — Kilpatrick Townsend & Stockton LLP

(57) ABSTRACT

Collapsible boats with foldable rigid transoms and a brace for the transom are disclosed. A collapsible boat includes a collapsible hull formed from a plurality of panels that extend from a first end to a second end of the collapsible/inflatable boat. Each of the panels is connected with at least one the other panels. The collapsible hull is configurable between a collapsed configuration and an expanded configuration. A folding rigid transom is used to constrain at least two rear margins of the panels when the hull is in the expanded configuration. The folding rigid transom and seats remain attached to the hull when the hull is in the collapsed configuration. A collapsible boat can have one or more interior members that are inflatable to support the collapsible hull in the expanded configuration.

24 Claims, 23 Drawing Sheets

(51) Int. Cl.
*B63B 29/04* (2006.01)
*B63B 7/08* (2006.01)

(56) References Cited

U.S. PATENT DOCUMENTS

| | | | | |
|---|---|---|---|---|
| 2,949,616 | A | 8/1960 | Desanges | |
| 3,228,043 | A | 1/1966 | Murray | |
| 3,473,502 | A | 10/1969 | Wittkamp | |
| 3,748,670 | A * | 7/1973 | Musson | 114/354 |
| 3,931,655 | A | 1/1976 | Luscombe | |
| 4,282,616 | A | 8/1981 | Battershill | |
| 4,314,018 | A | 2/1982 | Matsumoto et al. | |
| 4,449,473 | A | 5/1984 | McCrory et al. | |
| 4,556,009 | A | 12/1985 | Kaye | |
| 4,597,355 | A | 7/1986 | Kirby | |
| 4,660,499 | A | 4/1987 | Kaye | |
| 4,911,095 | A | 3/1990 | Kaye | |
| 5,372,085 | A | 12/1994 | Kaye | |
| 5,501,167 | A | 3/1996 | Kaye | |
| 5,524,570 | A | 6/1996 | Kaye | |
| 5,704,310 | A | 1/1998 | Cittadini | |
| 6,007,391 | A | 12/1999 | Eilert | |
| 6,164,237 | A | 12/2000 | Coryell et al. | |
| 6,196,152 | B1 * | 3/2001 | Cacioppo | B63B 7/06 114/354 |
| 6,739,278 | B2 | 5/2004 | Callahan | |
| 7,314,018 | B2 | 1/2008 | Ager | |
| 7,721,671 | B2 | 5/2010 | Ager et al. | |
| 8,413,600 | B2 | 4/2013 | Kaye | |
| 8,539,900 | B2 | 9/2013 | Kaye | |
| 2011/0265702 | A1 | 11/2011 | Kaye | |
| 2013/0247811 | A1 | 9/2013 | Kaye | |

FOREIGN PATENT DOCUMENTS

| | | | |
|---|---|---|---|
| CN | 201154763 | | 11/2008 |
| CN | 201721594 | | 1/2011 |
| DE | 3524974 | A1 | 2/1986 |
| DE | 3448029 | A1 | 4/1986 |
| EP | 761530 | | 3/1997 |
| GB | 221483 | | 2/1925 |
| GB | 2013586 | | 8/1979 |
| HK | 1178864 | | 9/2013 |
| JP | 49088497 | A | 8/1974 |
| JP | 62500001 | A | 1/1987 |
| JP | 09226674 | | 9/1997 |
| JP | 2000025684 | | 1/2000 |
| JP | 2001088772 | | 4/2001 |
| JP | 2002012183 | A | 1/2002 |
| JP | 2003118676 | A | 4/2003 |
| KR | 19860003451 | | 12/1986 |
| RU | 2041117 | C1 | 8/1995 |
| TW | 259074 | | 10/1995 |
| TW | M279575 | | 11/2005 |
| TW | 201139210 | | 11/2011 |
| TW | 201313555 | | 4/2013 |
| WO | 86/01782 | A1 | 3/1986 |
| WO | 9003914 | | 4/1990 |
| WO | 2013003807 | A1 | 1/2013 |
| WO | 2013003807 | A9 | 4/2013 |

OTHER PUBLICATIONS

U.S. Appl. No. 13/174,577 , "Notice of Allowance", Aug. 12, 2013, 8 pages.
Australian Application No. 2012203790, Patent Examiner Report, mailed Sep. 5, 2013, 3 pages.
Canadian Application No. 2,781,523, Office Action , mailed Sep. 13, 2013, 2 pages.
PCT/US2010/061349, International Search Report and Written Opinion, mailed Feb. 14, 2011, 15 pages.
PCT/US2012/045104, International Search Report and Written Opinion, mailed Dec. 10, 2012, 18 pages.
PCT/US2012/045104, Invitation to Pay Additional Fees and Partial International Search Report, mailed Oct. 24, 2012, 7 pages.
Quickboats. Product Brochure. Quickboats.com, No. Date Given [document created on Jul. 22, 2013], 6 pages.
Taiwanese Application No. 101122844, English translation of Official Letter and Search Report, mailed Oct. 15, 2013, 2 pages.
New Zealand Patent Application No. 619865, First Examination Report, mailed Oct. 24, 2014.
Singapore Patent Application No. 2013094982, Search and Examination Report, mailed Nov. 13, 2014.
Russian Patent Application No. 2014102964/(004552), Official Action, mailed Nov. 17, 2014, with English translation.
Chinese Patent Application No. 201210336125.2, Notice on the First Office Action, mailed Jul. 2, 2014.
U.S. Appl. No. 13/901,254, Non-Final Office Action, mailed Sep. 15, 2014.
U.S. Appl. No. 13/901,254, "Final Office Action", mailed Jan. 26, 2015, 6 pages.
U.S. Appl. No. 13/901,254, "Notice of Allowance", mailed Mar. 23, 2015, 7 pages.
CN201210336125.2, "Office Action", mailed Feb. 13, 2015, 9 pages.
JP2014-519196, "Office Action", mailed Jan. 23, 2015, 8 pages.
RU2014102964, "Decision on Grant", mailed Feb. 2, 2015, 15 pages.
CN201210336125.2 , "Office Action", mailed Jul. 21, 2015, 6 pages.
CO13-301337 , "Office Action", mailed Jul. 8, 2015, 10 pages.
KR1020147002719 , "Office action", mailed May 1, 2015, 12 pages.
AU2014277659, "Examination Report", mailed Aug. 27, 2015, 6 pages.
JP2014-519196 , "Final Rejection", mailed Sep. 3, 2015, 8 pages.
KR10-2014-7002719 , "Final Rejection", mailed Sep. 24, 2015, 7 pages.
TW103112544 , "Search Report", received Aug. 27, 2015, 2 pages.

* cited by examiner 22
42
18
18
18
20
24
14
50
58
54
40
48
38
12
52
56
16
46

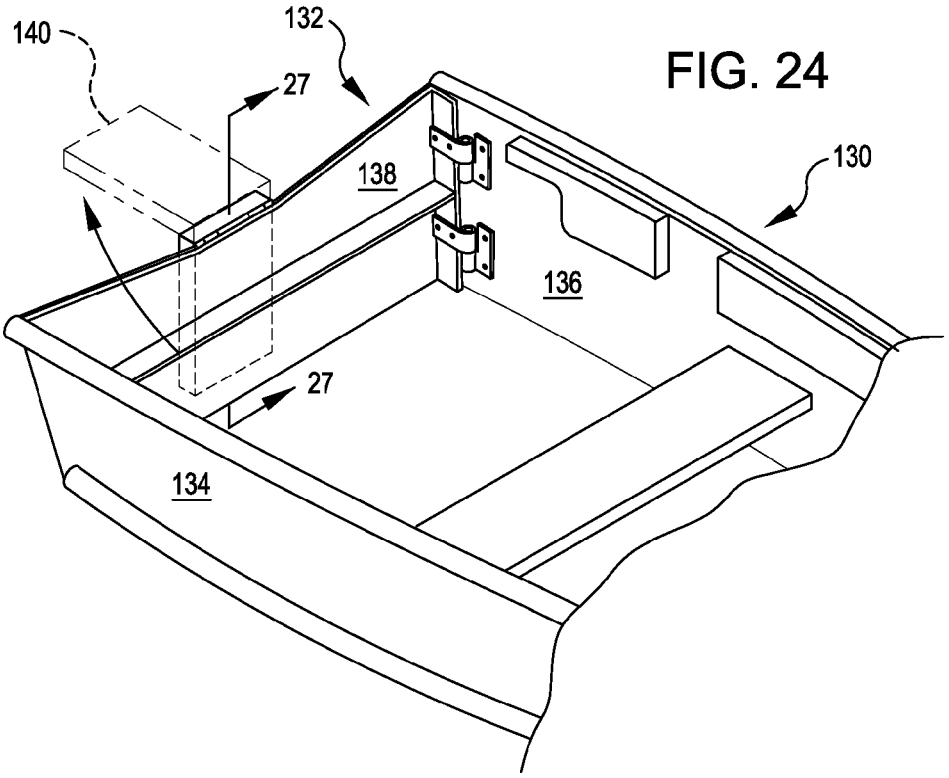
FIG. 24
FIG. 25
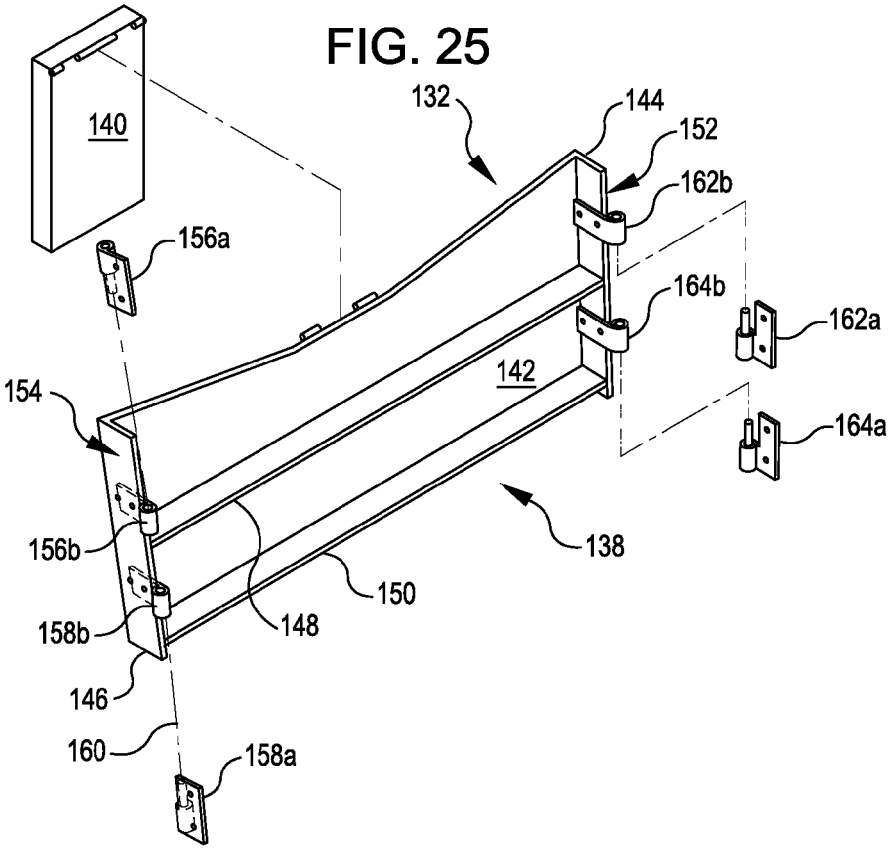

BRACE FOR FOLDING TRANSOM

CROSS-REFERENCES TO RELATED APPLICATIONS

This application is a continuation-in-part of U.S. application Ser. No. 13/901,254, filed May 23, 2013, which application is a continuation of U.S. application Ser. No. 13/174,577, filed Jun. 30, 2011, now issued U.S. Pat. No. 8,539,900, which application is a continuation-in-part of U.S. application Ser. No. 12/650,340, filed Dec. 30, 2009, now issued U.S. Pat. No. 8,413,600, the entire disclosures of which are hereby incorporated herein by reference.

BACKGROUND

Portable boats are popular with, for example, sportsmen and the like. Many such boats are relatively inexpensive and easily transportable, which contribute to their affordability and convenience. Such boats come in a wide range of configurations.

One popular configuration is a rigid boat that includes, for example, a pointed hull having a planar transom or a double-ended hull. Such rigid boats can be fabricated from a range of known materials, for example, polypropylene, aluminum, wood, fiberglass, and the like. Often, such rigid boats include a number of transverse seats.

Another popular configuration is a collapsible boat. Exemplary collapsible boats are disclosed in U.S. Pat. Nos. 4,556,009; 4,660,499; and 5,524,570. Many existing collapsible boats are light enough to be carried by a single person when collapsed.

Another popular configuration is an inflatable boat. Existing inflatable boats have inflatable side members and seats disposed between the inflatable side members.

Because of the continuing need for portable boats, improvements are always sought. Thus, there is believed to be a need for portable boats with enhanced features.

BRIEF SUMMARY

The following presents a simplified summary of some embodiments of the invention in order to provide a basic understanding of the invention. This summary is not an extensive overview of the invention. It is not intended to identify key/critical elements of the invention or to delineate the scope of the invention. Its sole purpose is to present some embodiments of the invention in a simplified form as a prelude to the more detailed description that is presented later.

Embodiments herein are directed to a folding or collapsible boat having a transom that remains attached when a hull for the boat is in the collapsed configuration. The transom can be attached so that it folds, e.g., via a hinge, from a collapsed state to an expanded state or configuration. A folding transom can be positioned to constrain the panel rear margins when the hull is in the expanded configuration. In many embodiments, a rigid transom enables the attachment of an outboard motor.

In many embodiments, the boat includes a plurality of removable or hinged solid seats. When installed, the removable seats constrain the panels when the hull is in the expanded configuration.

Thus, in another aspect, a boat is provided that includes a collapsible hull and a folding rigid transom. The collapsible hull has a first end and a second end. The hull includes a plurality of panels extending between the first end and the second end. Each of the panels is connected with at least one other of the panels. The hull is configurable between a collapsed configuration and an expanded configuration. The folding rigid transom constrains at least two rear margins of the panels when the hull is in the expanded configuration. And the folding rigid transom remains attached to the hull when the hull is in the collapsed configuration.

The folding rigid transom can have one or more separate sections. With a single-section transom, the folding rigid transom can have a first end that remains attached to the hull when the hull is in the collapsed configuration and a second end that is attachable to the hull to secure the folding rigid transom when the folding rigid transom constrains the at least two rear margins of the panels. As an example of more than one section, the folding rigid transom can include separate first and second sections, with each of the first and second sections remaining attached to the hull when the hull is in the collapsed configuration. In many embodiments, the first section is attachable to the second section to secure the folding rigid transom while the folding rigid transom constrains the at least two rear margins of the panels.

In many embodiments, the folding rigid transom interfaces with port and starboard panels of the collapsible hull when the hull is in the expanded configuration. For example, the folding rigid transom can include a port side surface and a starboard side surface that are configured to interface with port and starboard side panels, respectively, when the hull is in the expanded configuration. The folding rigid transom can be hinged to the hull so that port and starboard side panels do not interfere with the folding rigid transom as it is folded. For example, the boat can include one or more hinges having a common hinge line, the common hinge line being disposed forward of at least one of the port and starboard side surfaces of the transom when the hull is in the expanded configuration, the one or more hinges remaining coupled with the folding rigid transom and the hull when the hull is in the collapsed configuration.

In many embodiments, the boat further comprises one or more hinges having a common hinge line. The one or more hinges remain coupled with the folding rigid transom and the hull when the hull is in the collapsed configuration. In many embodiments, the folding rigid transom can be translated along the common hinge line relative to the hull by a predetermined amount to facilitate configuring the folding rigid transom to constrain the at least two rear margins of the panels. The ability to translate the folding rigid transom along the common hinge line by the predetermine amount can be provided by using two hinges configured to allow the predetermined amount of translation. For example, the one or more hinges can include a first hinge that includes a first member and a second member, and a second hinge that includes a third member and a fourth member. The second and fourth members can be attached to one of the hull or the folding rigid transom and disposed between the first and third members. The second and fourth member can then be offset from the first and third members so as to provide the predetermined amount of translation of the folding rigid transom along the common hinge line relative to hull.

In many embodiments, the boat further includes a releasable connector operable to prevent folding of the rigid transom when the folding rigid transom is constraining the at least two rear margins of the panels. For example, the releasable connector can include one or more vertically oriented retaining pins. As another example, the releasable connector can include one or more reconfigurable latch members. The folding rigid transom can include one or more slots configured to receive the one or more reconfigurable latch members extending there through. And the one or more reconfigurable latch members can be coupled with the hull and configurable to engage the folding rigid transom adjacent to the one or more slots to prevent folding of the folding rigid transom when the folding rigid transom is constraining the at least two rear margins of the panels.

In many embodiments, each panel has a rear margin disposed to the second end of the boat, and the collapsible hull includes a flexible diaphragm connected with the rear margins of the panels. The flexible diaphragm has a substantially compact configuration when the hull is in the collapsed configuration. And the flexible diaphragm provides a water-tight barrier when the hull is in the expanded configuration.

In many embodiments, the boat includes a motor mount configured to provide a support interface for an outboard motor. In many embodiments, the motor mount is configurable into a deployed configuration in which the motor mount is coupled with the folding rigid transom and a portion of the flexible diaphragm is disposed between the motor mount and the folding rigid transom. The motor mount can be rotationally coupled with and/or removably coupled with the folding rigid transom.

In embodiments, the boat can include a brace for extending between the folding transom and another part of the boat when the folding transom is in the expanded configuration. The brace can be connected, for example, to the back of a seat, a floor for the boat, a side for the boat, or another feature of the boat. The brace acts to prevent flexing of the transom inward or outward relative to the center of the boat. This feature can permit larger boat motors to be installed without risk of the transom collapsing, bending too far outward due to force vectors generated by a motor accelerating a boat.

For a fuller understanding of the nature and advantages of the present invention, reference should be made to the ensuing detailed description and accompanying drawings.

BRIEF DESCRIPTION OF THE DRAWINGS

FIG. 24 is a perspective view illustrating a boat that includes a collapsible hull and a folding rigid transom, showing a port side releasable coupling between the folding rigid transom and a port side panel of the hull, in accordance with many embodiments.

FIG. 25 is an exploded perspective view illustrating the folding rigid transom of FIG. 24.

DETAILED DESCRIPTION

In the following description, various embodiments of the present invention will be described. For purposes of explanation, specific configurations and details are set forth in order to provide a thorough understanding of the embodiments. The present invention, however, can be practiced without the specific details. Furthermore, well-known features can be omitted or simplified in order not to obscure the embodiment being described.

Collapsible/Inflatable Boat

Figure 1:
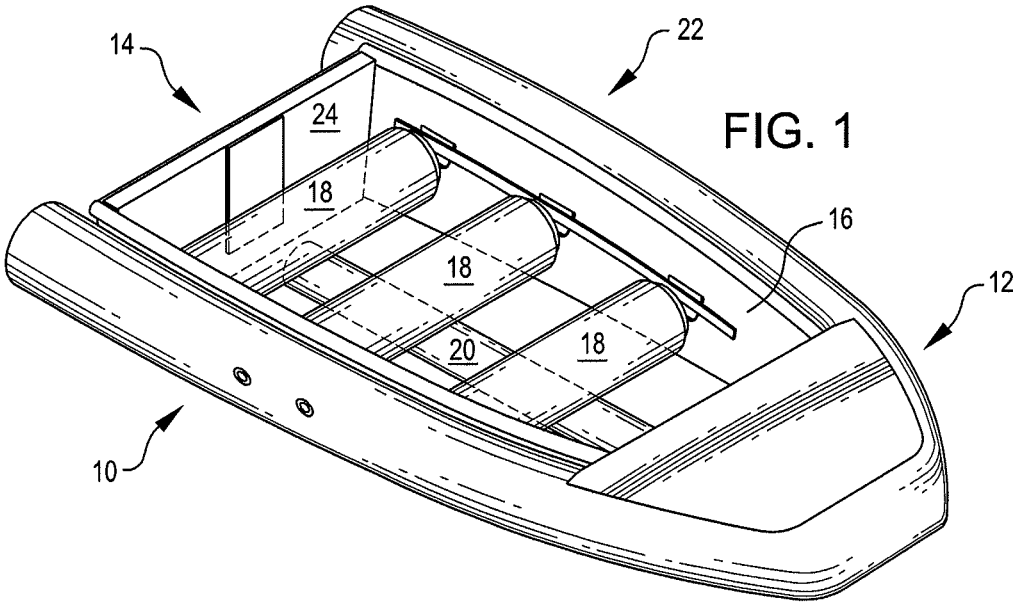
FIG. 1 is a perspective view of a collapsible boat with inflatable members in an expanded and inflated configuration, in accordance with many embodiments.

Referring now to the drawings, in which like reference numerals represent like parts throughout the several views, FIG. 1 shows a collapsible/inflatable boat 10, in accordance with many embodiments. In accordance with embodiments herein, a collapsible/inflatable boat is a boat with a collapsible hull that includes rigid, semi-rigid, or flexible hull panels and one or more interior and/or exterior inflatable members. The hull is a solid, shaped hull that is collapsible or foldable into a storage configuration, and expandable into a use configuration. An exterior inflatable member can take the form of one or more flexible tubes disposed adjacent the gunwale of the boat.

In the embodiment shown in the drawings, the collapsible/inflatable boat 10 has a somewhat pointed bow 12 and a planar stern 14. The collapsible/inflatable boat 10 includes a collapsible hull 16, three inflatable transverse interior members 18, an inflatable longitudinal interior member 20, an exterior assembly 22, and a removable transom 24. The inflatable transverse members 18, in addition to providing internal support to the collapsible hull 16 as described below, further provide passenger seats.

Figure 2:
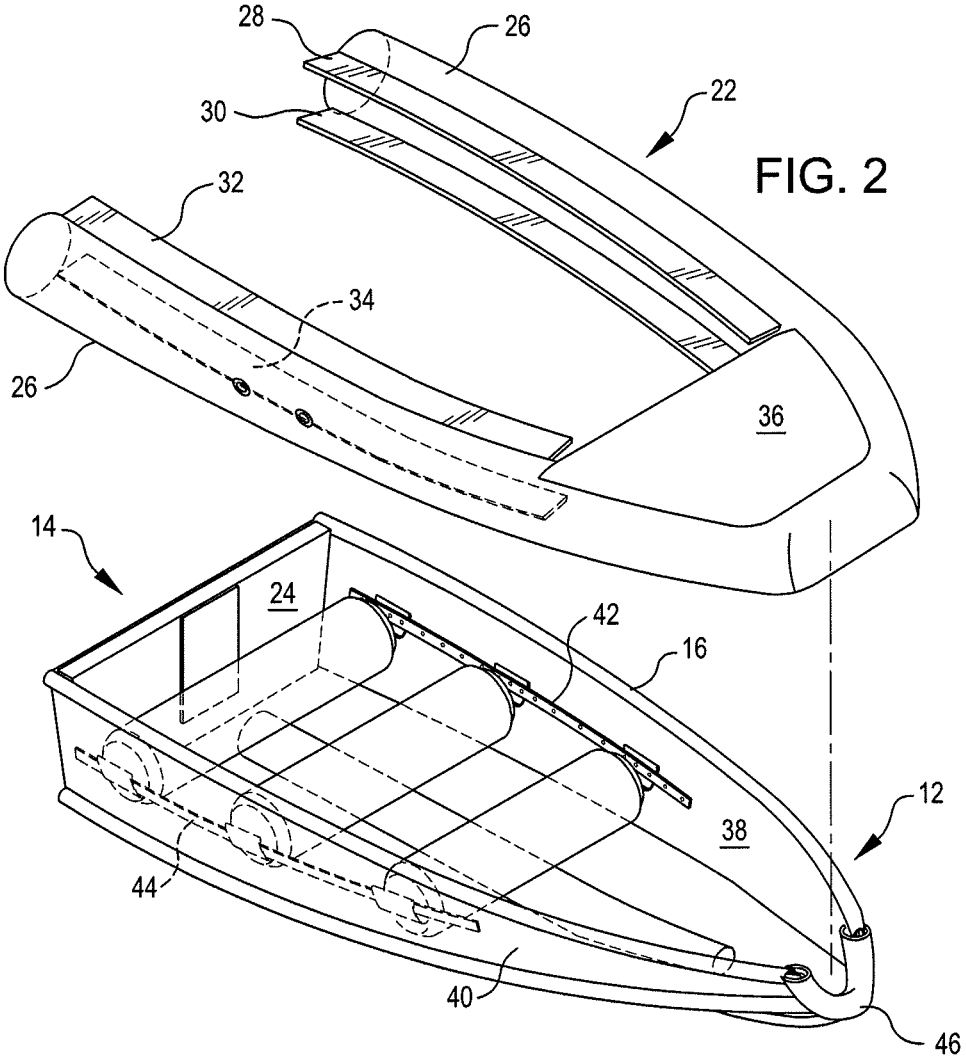
FIG. 2 is an exploded perspective view of the collapsible boat of FIG. 1 that separately illustrates an assembly comprising a collapsible hull and inflatable interior members, and an assembly comprising an exterior inflatable member, in accordance with many embodiments.

FIG. 2 shows the exterior assembly 22 separate from the rest of the collapsible/inflatable boat 10. The exterior assembly 22 includes an inflatable exterior member 26 having a tubular shape and configured to surround a perimeter portion of the hull 16. The exterior assembly 22 includes a port upper-attachment membrane 28, a port lower-attachment membrane 30, a starboard upper-attachment membrane 32, and a starboard lower-attachment membrane 34. The attachment membranes 28, 30, 32, 34 are used to connect the exterior assembly 22 to the collapsible hull 16. The exterior assembly 22 further includes a bow membrane 36 that is attached to the inflatable exterior member 26 at the bow.

The collapsible hull 16 includes a plurality of interconnected panels extending between the bow 12 and the stern 14. The panels can be rigid, semi-rigid, or flexible. The panels are movable between a collapsed configuration and an expanded configuration. When in the expanded configuration, the hull 16 forms a non-inflatable structural portion of the boat that is water tight. While any suitable number of panels can be used, the hull 16 includes four panels. As will be described in more detail below, the hull 16 includes a pair of interconnected lower or bottom panels and a pair of side panels connected with respective bottom or lower panels. The hull 16 includes a flexible or yieldable diaphragm or flexible transom connected to the stern-side margins of the panels and providing a water-tight barrier when the hull is in the expanded configuration. Details of such a collapsible hull are described in U.S. Pat. No. 5,524,570, the full disclosure of which is hereby incorporated herein by reference. While the details provided therein disclose an embodiment of a collapsible hull, many other collapsible configurations can be used having rigid, semi-rigid, flexible, and/or other solid components that hinge, bend, fold, or otherwise move so that the hull can be configured between a collapsible state and an expanded state. For example, a collapsible hull having a double-ended expanded configuration can be used.

As illustrated in FIG. 2, the three inflatable transverse interior members 18 are connected with a port side panel 38 and a starboard side panel 40 via a port interior-attachment member 42 and a starboard interior-attachment member 44, respectively. When inflated, each of the transverse members 18 provide a column support between the side panels 38, 40, thereby helping to keep the collapsible hull 16 in the expanded configuration. The transverse members 18 also serve as an upper constraint to the inflatable longitudinal interior member 20, which is positioned to interface with the bottom panels of the collapsible hull 16 to provide vertical constraint to the bottom panels along their mutual connection line. The transverse members 18 react vertical loads from the longitudinal member 20 into the side panels 38, 40 via the interior-attachment members 42, 44.

The collapsible/inflatable boat 10 includes bow and stern components. A bow panel end cover 46 is installed over the bow ends of the hull panels and serves to protect the exterior assembly 22 from chaffing damage that may arise from contact and relative motion between the bow ends of the hull panels and the exterior assembly 22. Also, the removable transom 24 is shown in its installed position. The removable transom 24 can be constructed in a variety of ways, for example, as a unitary piece, as a welded metal assembly, etc. A folding rigid transom that remains attached to at least one of the hull panels when the collapsible hull is in the collapsed configuration can be used in place of the removable transom 24. For example, a folding rigid transom can be made by attaching the transom 24 to one of the side panels 38, 40 via a hinge disposed along an edge of the transom 24 that interfaces with one of the side panels 38, 40.

Figure 3:
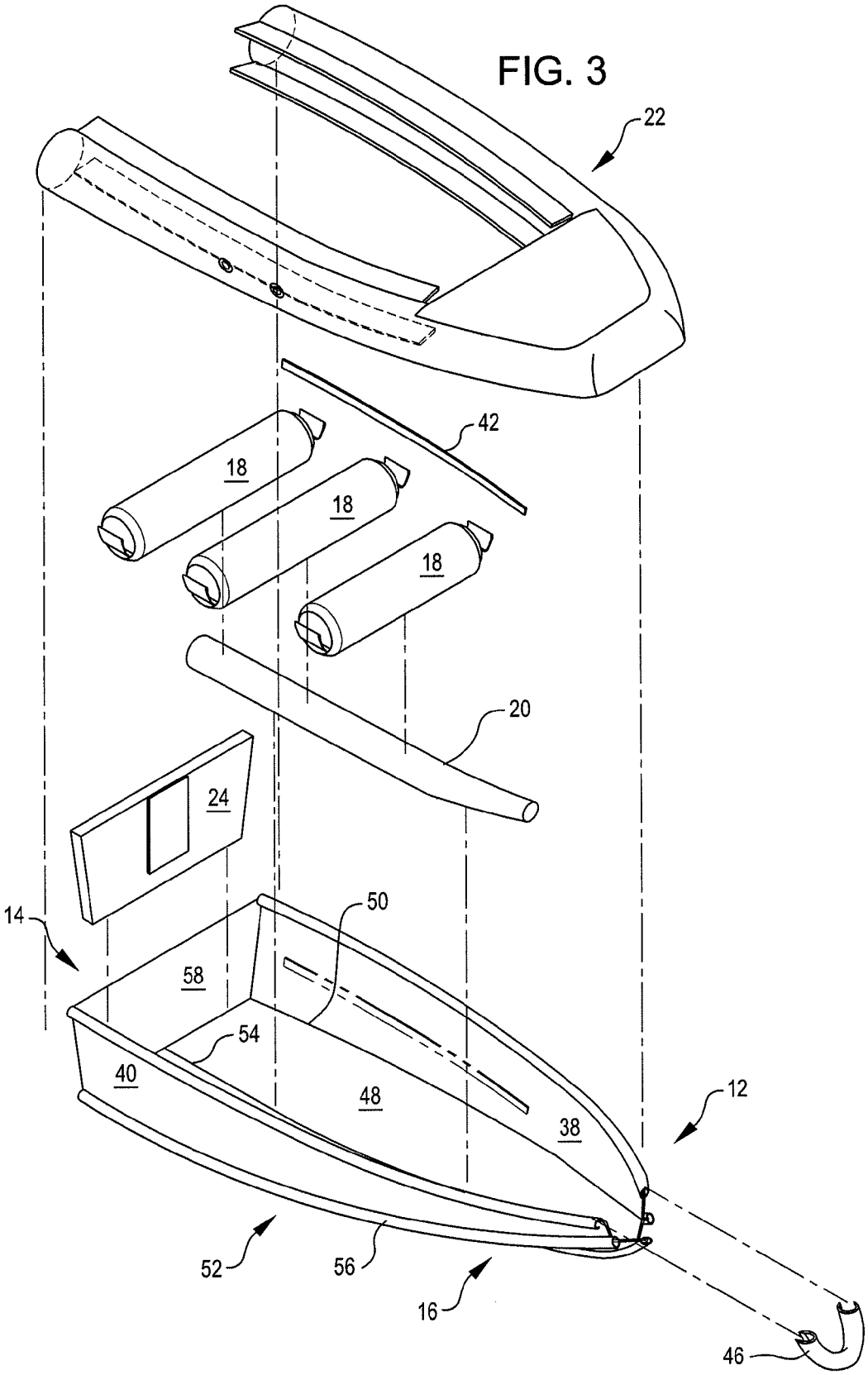
FIG. 3 is an exploded perspective view of the boat of FIG. 1 that separately illustrates the inflatable interior members and a removable transom member, in accordance with many embodiments.

FIG. 3 is an exploded perspective view that separately illustrates the exterior assembly 22, the collapsible hull 16, the inflatable transverse interior members 18, the inflatable longitudinal interior member 20, the bow panel end cover 46, the removable transom 24, and the port-interior attachment member 42. The inflatable longitudinal interior member 20 can be attached to one or more of the transverse interior members 18, or just inserted and held in place between the transverse members 18 and the collapsible hull 16. The collapsible hull 16 includes the port side panel 38, a port bottom panel 48 connected with the port side panel 38 along a connection 50 running between the bow 12 and the stern 14, a starboard bottom panel 52 connected with the port bottom panel 48 along a connection 54 running between the bow 12 and the stern 14, and the starboard side panel 40 connected with the starboard bottom panel 52 along a connection 56 running between the bow 12 and the stern 14. The collapsible hull 16 also includes a flexible diaphragm 58 at the stern 14 that is attached to the stern ends of the hull panels 38, 48, 52, 40 so as to provide a water-tight barrier at the stern 14 when the hull 16 is in the expanded configuration. The flexible diaphragm 58 is configured to have a substantially compact configuration when the collapsible hull 16 is in the collapsed configuration, and to deploy into a substantially planar configuration when the collapsible hull 16 is in the expanded configuration (illustrated in FIG. 3). The removable transom 24 can be inserted into the collapsible hull 16 to constrain the stern ends of the hull panels 38, 48, 52, 40 (panel aft margins) when the hull 16 is in the expanded configuration. The removable transom 24 can be attached to the collapsible hull panels any suitable way. For example, the removable transom 24 can be configured with one or more projections that fit into one or more grooves formed by one or more elongated members bonded to the surfaces of the hull panels such as described in U.S. Pat. No. 5,524,570. The removable transom 24 can also be attached with the panel aft margins using removable fasteners. While the collapsible/inflatable boat 10 includes both the flexible diaphragm 58 and the removable transom 24, one or both of these components can be replaced with a suitable equivalent (e.g., a water-tight removable transom, an inflatable transom, a flexible diaphragm without a removable transom, a folding rigid transom). The removable transom 24 can be made of any suitable solid material of sufficient strength.

Figure 4:
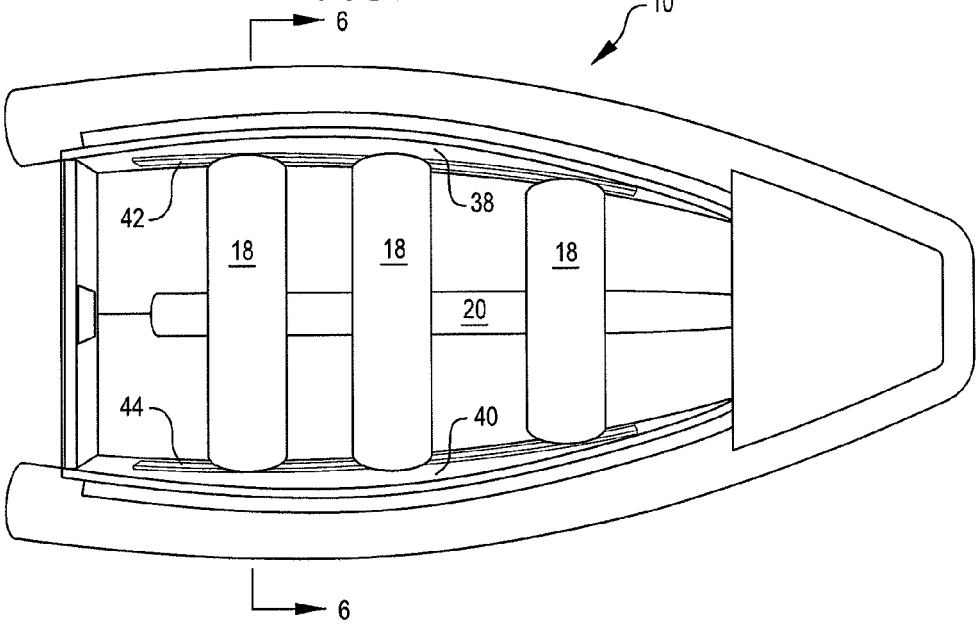
FIG. 4 is a plan view of the boat of FIG. 1 that illustrates the layout of the inflatable interior members, in accordance with many embodiments.

FIG. 4 is a plan view of the collapsible/inflatable boat 10, and illustrates the layout of the inflatable transverse interior members 18 and the inflatable longitudinal interior member 20. Each of the inflatable transverse interior members 18 are connected to the port side panel 38 via the port interior-attachment member 42. And each of the inflatable transverse interior members 18 is connected to the starboard side panel 40 via the starboard interior-attachment member 44.

Figure 5:
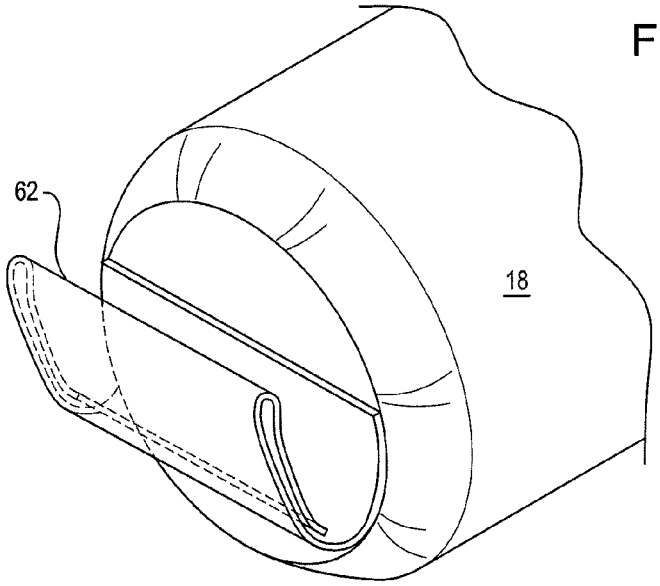
FIG. 5 is a perspective view of an end of an inflatable transverse interior member illustrating an attached membrane for coupling the transverse inflatable member with a side panel of a hull, in accordance with many embodiments.

FIG. 5 illustrates an end of one of the inflatable transverse interior members 18. A side attachment membrane 62 is attached to each end of each transverse member 18. The side attachment membrane 62 can be a rectangular membrane that is attached (e.g., bonded) to the end of the transverse member 18 over an end portion of the side attachment membrane 62. The length of the attachment membrane 62 can be selected to allow the side attachment membrane 62 to be folded into an installation configuration illustrated in FIG. 5.

Figure 6:
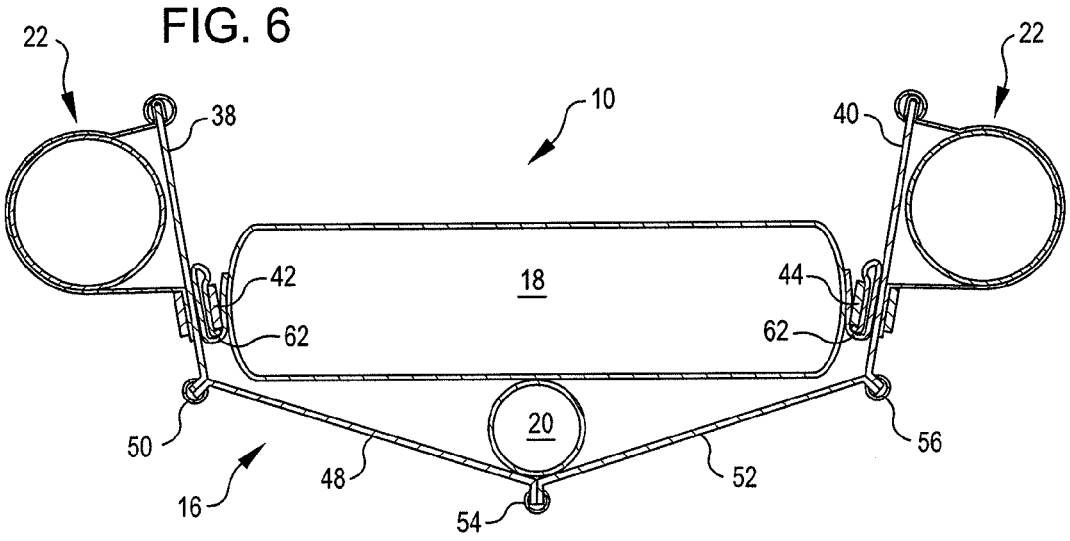
FIG. 6 is a cross-sectional view illustrating a transverse cross-section of the boat of FIG. 1, in accordance with many embodiments.

FIG. 6 illustrates a cross-section 6-6 (as defined in FIG. 4) of the collapsible/inflatable boat 10. The cross-section 6-6 illustrates the collapsible hull 16, one of the inflatable transverse members 18, the inflatable longitudinal member 20, and the exterior assembly 22.

The collapsible hull 16 includes the port side panel 38, the port bottom panel 48 connected with the port side panel 38 along the connection 50 that runs between the bow 12 and the stern 14, the starboard bottom panel 52 connected with the port bottom panel 48 along the connection 54 that runs between the bow 12 and the stern 14, and the starboard side panel 40 connected with the starboard bottom panel 52 along the connection 56 that runs between the bow 12 and the stern 14. The connections 50, 54, 56 can be configured, for example, as described in U.S. Pat. No. 5,524,570. The hull panels can be made from a copolymer material that contains polypropylene, which may be beneficial due to its ability to be folded and unfolded many times without sustaining any significant damage. The hull panels can also be made from aluminum or a plastic material, but may not be as efficient or strong as a polypropylene copolymer material. Neoprene or other similar materials can be used in the connections 50, 54, 56, but do not have the same properties as polypropylene.

Each of the inflatable transverse members 18 is configured to support the collapsible hull in the expanded configuration. Each transverse member 18, when inflated, provides a column support between the port side panel 38 and the starboard side panel 40 that maintains the separation between the side panels 38, 40 in the expanded configuration of the collapsible hull 16. Additionally, each transverse member 18 pushes down on the inflatable longitudinal member 20, which in turn pushes down on the bottom panels 48, 52 along their mutual connection 54 to further help maintain the expanded configuration of the collapsible hull 16. Each transverse member 18 reacts the upward load from the longitudinal member 20 to the port side panel 38 via a side attachment membrane 62 and the port interior-attachment member 42, and to the starboard side panel 40 via a side attachment membrane 62 and the starboard interior-attachment member 44.

The inflatable longitudinal member 20 provides a running support of the bottom panels 48, 52 along their mutual connection 54. The resulting upward load on the longitudinal member 20 is then reacted into the transverse members 18.

Figure 7:
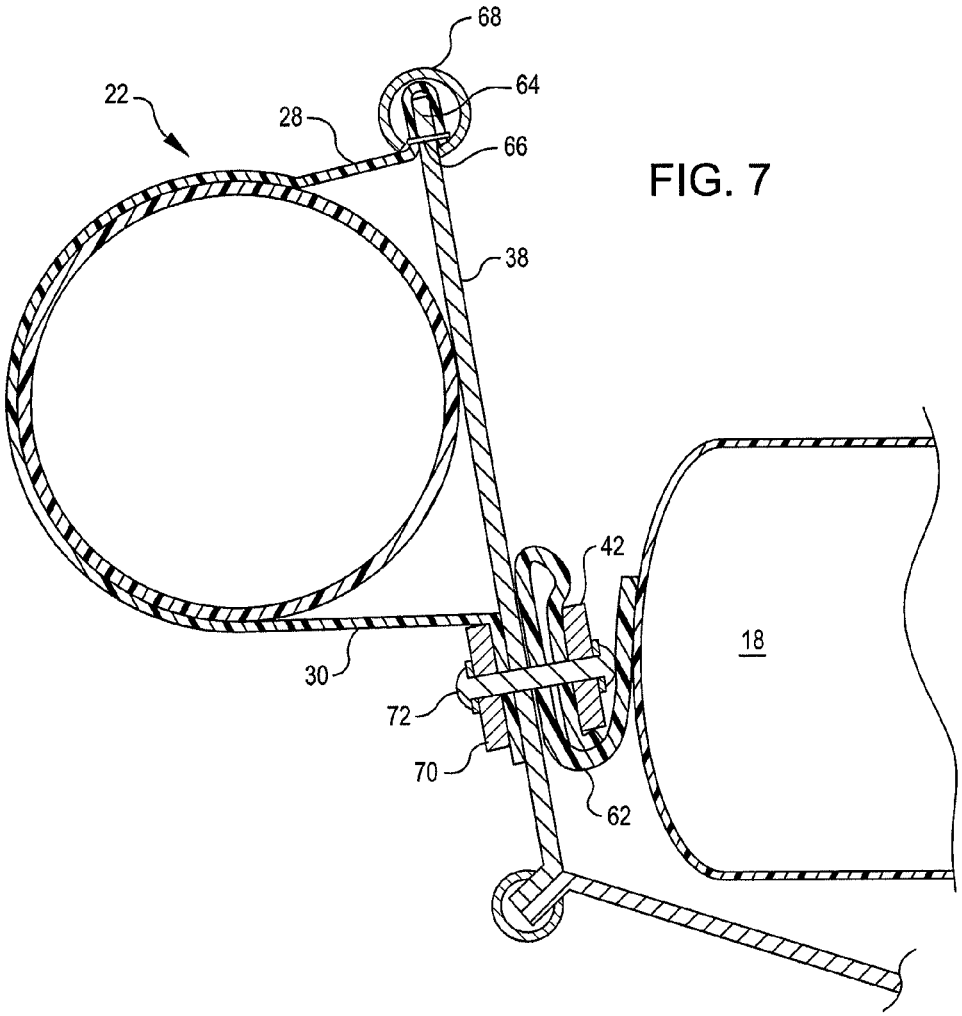
FIG. 7 is a cross-sectional view illustrating the connection of an inflatable exterior member and an inflatable transverse interior member with a side panel of the boat of FIG. 1, in accordance with many embodiments.

FIG. 7 illustrates details of the connection of the exterior assembly 22 with the collapsible hull 16, and details of the connection of one of the transverse members 18 with the collapsible hull 16. While the port side is illustrated, in many embodiments, the corresponding starboard connections are the same as the port connections.

The exterior assembly 22 is connected with the port side of the collapsible hull 16 via the port upper-attachment membrane 28 and the port lower-attachment membrane 30. The port upper-attachment membrane 28 is wrapped over a port side panel upper edge 64 of the port side panel 38 and fastened to the port upper edge 64 using a series of attachment fasteners 66 (e.g., staples). A cover member 68 is installed over the connection between the port upper-attachment membrane 28 and the port upper edge 64, and can serve to stiffen the port upper edge 64 and define a port gunwale for the collapsible hull 16. The port lower-attachment membrane 30 is connected with the port side panel 38 below the port side panel upper edge 64 via a port exterior-attachment member 70 and a series of attachment fasteners 72 (e.g., rivets).

As illustrated, the attachment between the transverse member 18 and the port side panel 38 can be aligned with the connection between the port lower-attachment membrane 30 and the port side panel 38. Such an alignment may serve to reduce the loads imparted into the port side panel 38 by the port lower-attachment membrane 30 by providing a direct load path into the transverse member 18. Such an alignment also enables the use common attachment fasteners 72. The transverse member 18 is connected with the port side panel 38 via a side attachment membrane 62. As illustrated, the side attachment membrane 62 is folded and clamped to the side panel 38 via the port interior-attachment member 42. The folded configuration illustrated places a portion of the side attachment membrane 62 between the port interior-attachment member 42 and the transverse member 18, which helps to protect the transverse member 18 from chaffing damage from contact with and movement relative to the port interior-attachment member 42.

Collapsible/Inflatable Boat with Non-Inflatable Interior Members

Figure 8:
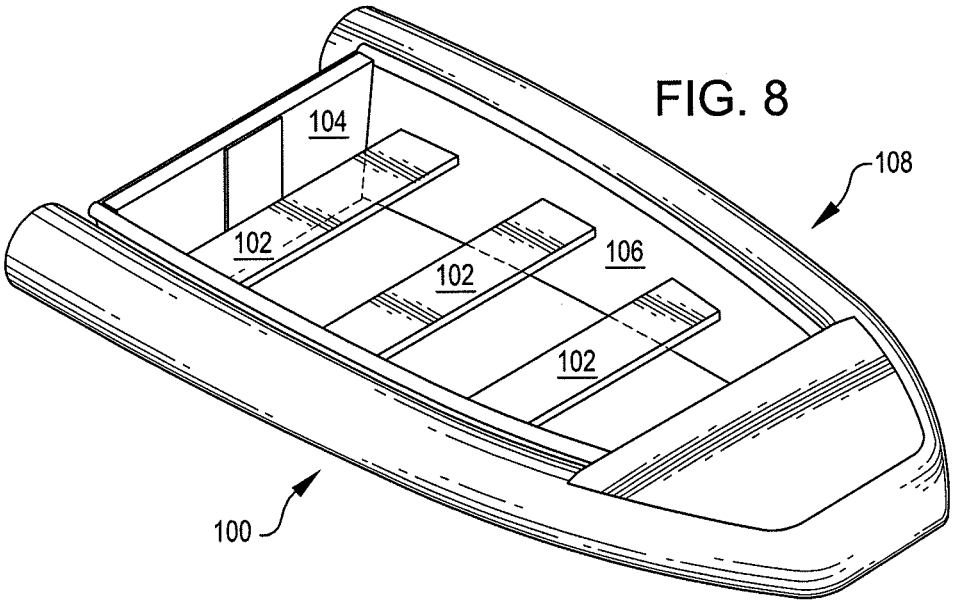
FIG. 8 is a perspective view of a collapsible boat with an inflatable exterior member and non-inflatable removable seats, in accordance with many embodiments.
Figure 9:
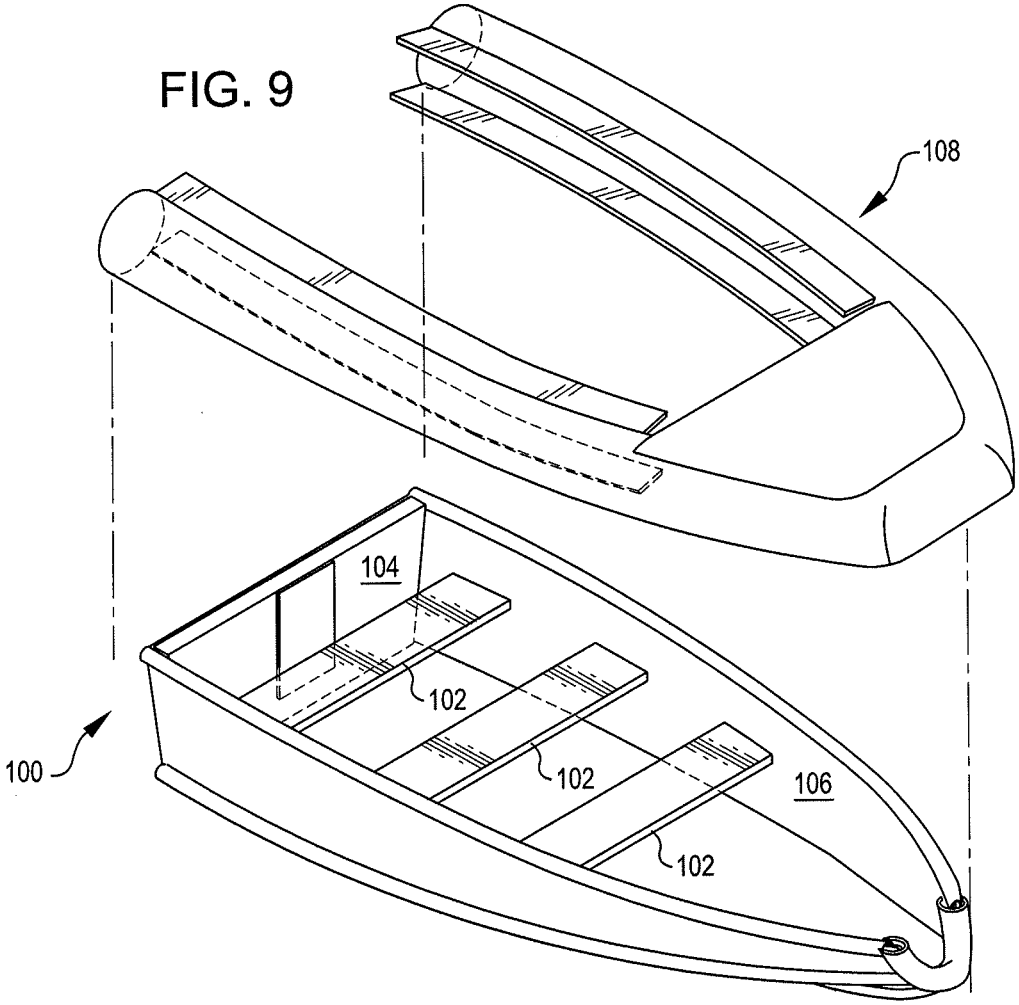
FIG. 9 is an exploded perspective view of the boat of FIG. 8 that separately illustrates an assembly comprising a collapsible hull and removable solid seats, and an assembly comprising an inflatable exterior member, in accordance with many embodiments.

FIG. 8 and FIG. 9 illustrate a collapsible/inflatable boat 100 that employs removable solid seats 102 and a removable transom 104 to support a collapsible hull 106 in an expanded configuration. The collapsible hull 106 can include any suitable feature of the above-described collapsible hull 16. Additionally, the collapsible hull can be configured as described in U.S. Pat. No. 5,524,570. The collapsible/inflatable boat 100 includes an inflatable exterior assembly 108. The exterior assembly 108 can be configured the same as the above-described exterior assembly 22, and can be attached to the collapsible hull 106 the same as described above with regard to the exterior assembly 22 and the collapsible hull 16.

Boat Expansion (Collapsible/Inflatable Boat 10)

Figure 10A:
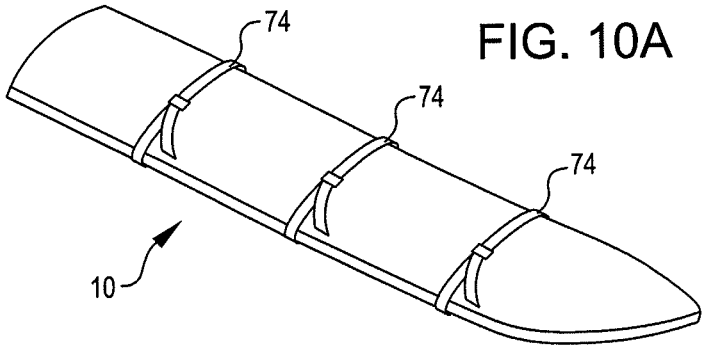
FIG. 10A is a perspective view illustrating the collapsible boat of FIG. 1 in a collapsed configuration, in accordance with many embodiments.

FIG. 10A illustrates the collapsible/inflatable boat 10 of FIG. 1 in the collapsed configuration. When the collapsible/inflatable boat 10 is in the collapsed configuration, the inflatable members 18, 20, 26 are in an un-inflated state and the side panels 38, 40 are folded down over the deflated interior members 18, 20, which are disposed between the down-folded side panels 38, 40 and the bottom panels 48, 52. The flexible diaphragm 58 is also in a collapsed configuration. Straps 74 can be used to constrain the collapsible/inflatable boat 10 in the collapsed configuration. When collapsed, the collapsible/inflatable boat 10 can be carried in a compact, substantially flat condition, for example, on the side or top of a vehicle.

Figure 10B:
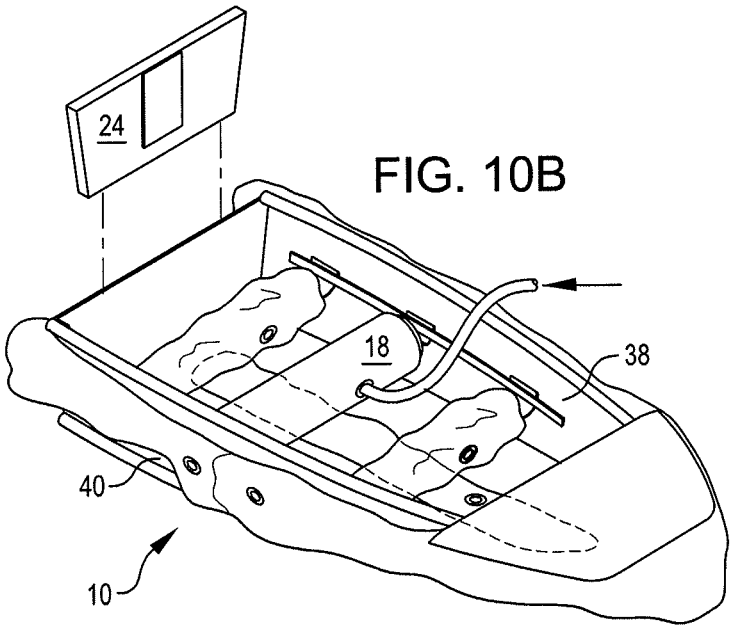
FIG. 10B is a perspective view illustrating the inflation of a first inflatable transverse member and the installation of a removable transom during the expansion process for the boat of FIG. 1, in accordance with many embodiments.
Figure 10C:
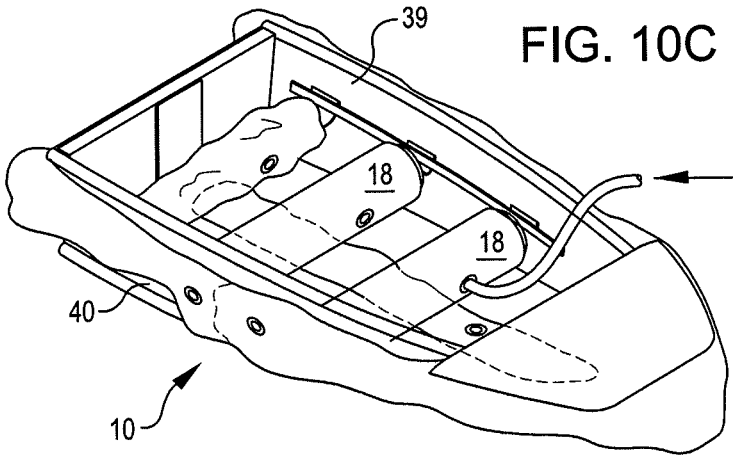
FIG. 10C is a perspective view illustrating the inflation of a second inflatable transverse member during the expansion process for the boat of FIG. 1, in accordance with many embodiments.
Figure 10D:
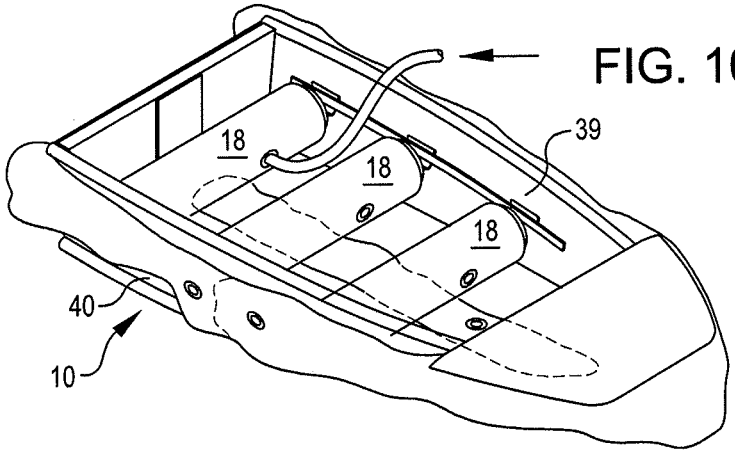
FIG. 10D is a perspective view illustrating the inflation of a third inflatable transverse member during the expansion process for the boat of FIG. 1, in accordance with many embodiments.
Figure 10E:
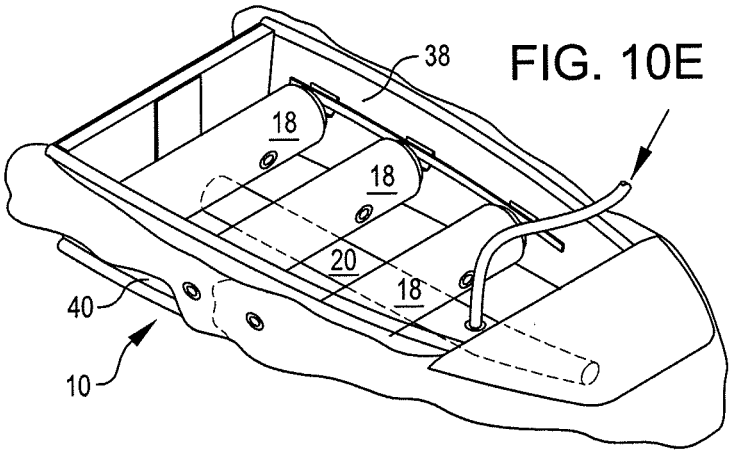
FIG. 10E is a perspective view illustrating the inflation of the inflatable longitudinal member during the expansion process for the boat of FIG. 1, in accordance with many embodiments.
Figure 10F:
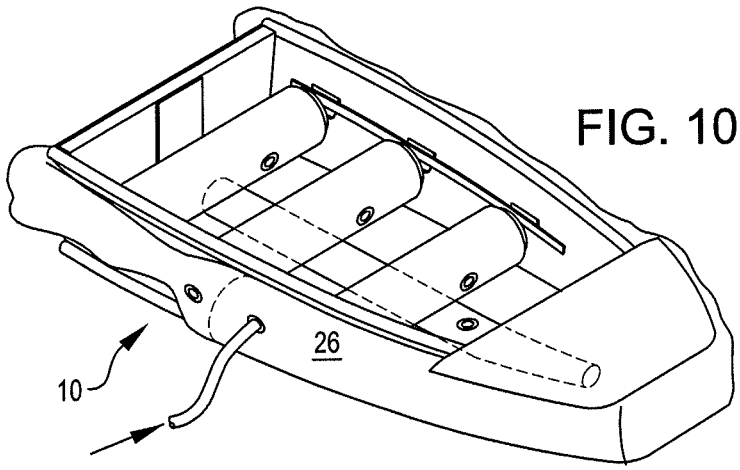
FIGS. 10F through 10H are perspective views illustrating the inflation of the inflatable exterior member during the expansion process for the boat of FIG. 1, in accordance with many embodiments.
Figure 10G:
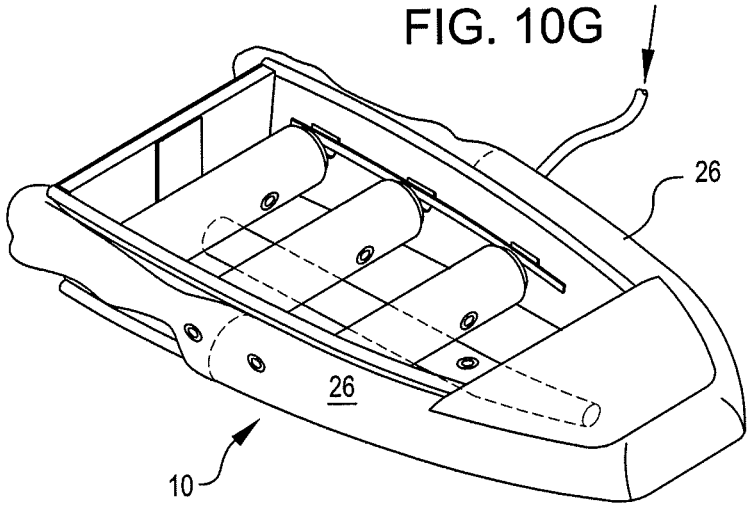
Figure 10H:
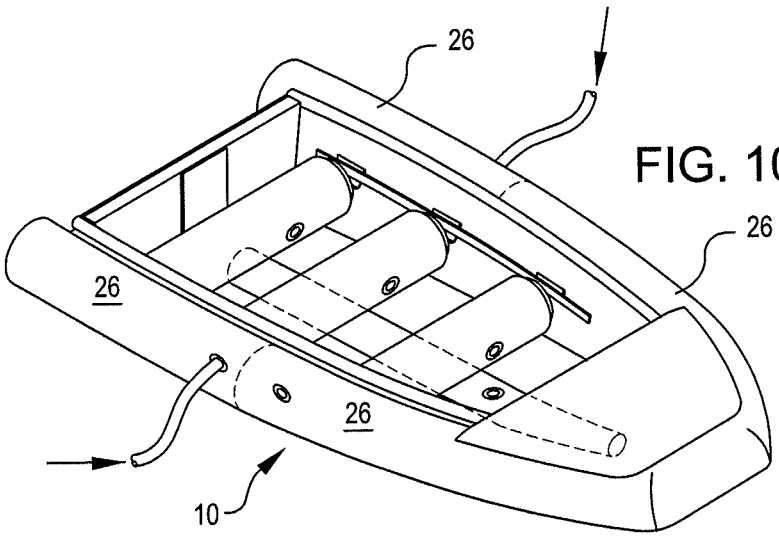

To expand the collapsible/inflatable boat 10, the side panels 38, 40 can be moved apart with respect to the bottom panels 48, 52 to provide access to the inflatable interior members 18, 20. Alternatively, inflation of any one or more of the transverse inflatable members 18 can be used to move the side panels 38, 40 apart with respect to the bottom panels 48, 52. For example, with the boat in the collapsed configuration as illustrated in FIG. 10A and the straps 74 removed, an inflation tube coupled with any one or more of the transverse inflatable members 18 can extend to an accessible location (e.g., beyond the aft edge of the panels 38, 40, 48, 52) where it can be used to inflate the selected inflatable member(s), thereby moving the side panels 38, 40 apart with respect to the bottom panels 48, 52. While any one or more of the transverse inflatable members 18 can be inflated via an inflation tube to move the side panels 38, 40 apart with respect to the bottom panels 48, 52, in many embodiments, a central transverse inflatable member 18 is inflated to move the side panels 38, 40 apart with respect to the bottom panels 48, 52. Inflation of the interior members 18, 20 reconfigures the collapsible hull 16 into the expanded configuration. Specifically, inflation of the transverse members 18 provides column supports between the side panels 38, 40 so as to maintain the separation between the side panels 38, 40 in the expanded configuration. As illustrated in FIG. 10B, the expansion process can start with the inflation of the center transverse member 18 and the installation of the removable transom 24. Next, the forward transverse member 18 can be inflated as illustrated in FIG. 10C. And then the aft transverse member 18 can be inflated as illustrated in FIG. 10D. Inflation of the longitudinal member 20 as illustrated in FIG. 10E provides the above-described running support of the bottom panels 48, 52. As a result, the inflation of the interior members 18, 20 drives the collapsible hull 16 into the expanded configuration and thereafter maintains the collapsible hull 16 in the expanded configuration. The exterior inflatable member 26 is also inflated during the expansion of the collapsible/inflatable boat 10 as illustrated in FIG. 10F through FIG. 10H. While a specific expansion sequence is illustrated in FIG. 10A through FIG. 10H, the inflation of the interior members 18, 20, the inflation of the exterior member 26, and the installation of the removable transom 24 can be accomplished in any suitable order.

In many embodiments, each of the interior members 18, 20 is a separate inflatable member that is inflated through a separate inflation orifice or valve. As illustrated in FIG. 10F, FIG. 10G and FIG. 10H, the exterior inflatable member 26 can include one or more separate inflatable portions, each of which can be inflated through a separate inflation orifice or valve. Any suitable inflation means can be used, for example, a hand pump, an electric pump, an air compressor, etc. With a suitable hand pump, the collapsible/inflatable boat 10 can be expanded in about ten minutes to twenty minutes.

The removable transom 24 is also attached during the expansion of the collapsible/inflatable boat 10. While any suitable means of attachment can be used, in many embodiments the removable transom is attached to the panel rear margins using removable fasteners. While the removable transom can be installed on either side of the flexible diaphragm 58, in many embodiments, the transom 24 is installed inside of the flexible diaphragm 58. While the transom 24 can be attached at any point during the expansion of the collapsible/inflatable boat 10, it may be easier to attach the transom 24 after the inflation of at least one of the interior members 18, 20 due to constraint supplied by the inflated interior members 18, 20. On the other hand, it may be easier to inflate the interior members 18, 20 after the attachment of the transom 24 due to the constraint supplied by the transom 24.

Boat Expansion (Collapsible/Inflatable Boat 100)

When the collapsible/inflatable boat 100 is in the collapsed configuration, the inflatable exterior member 26 is in an uninflated state and the side panels of the collapsible hull 106 are folded down over the bottom panels of the collapsible hull 106. The flexible diaphragm of the collapsible hull 106 is also in a collapsed configuration. When collapsed, the collapsible/inflatable boat 100 can be carried in a compact, substantially flat condition, for example, on the side or top of a vehicle.

To expand the collapsible/inflatable boat 100, the side panels are moved apart with respect to the bottom panels and the removable solid seats 102 are put into place between the side panels as shown in FIG. 8 and FIG. 9. Each of the removable solid seats 102 includes a leg or strut (not shown) secured to the underside of the removable solid seat 102 and extending downwardly and snuggly fits into the crevice formed by the connection between the bottom panels along the longitudinal fore and aft connection.

The removable transom 104 is also attached during the expansion of the collapsible/inflatable boat 100. While any suitable means of attachment can be used, in many embodiments the removable transom 104 is attached to the panel rear margins using removable fasteners. While the removable transom 104 can be installed on either side of the flexible diaphragm of the collapsible hull 106, in many embodiments, the transom 104 is installed inside of the flexible diaphragm. While the transom 104 can be attached at any point during the expansion of the collapsible/inflatable boat 100, it may be easier to attach the transom 104 after the installation of at least one of the removable solid seats 102 due to the constraint supplied by the removable solid seats 102.

The inflatable exterior member 26 is also inflated during the expansion of the collapsible/inflatable boat 100. The inflation of the exterior member 26 and the installation of the removable seats 102 can be accomplished in any suitable order.

Installation of an Inflatable Exterior Assembly During Manufacture

Figure 11:
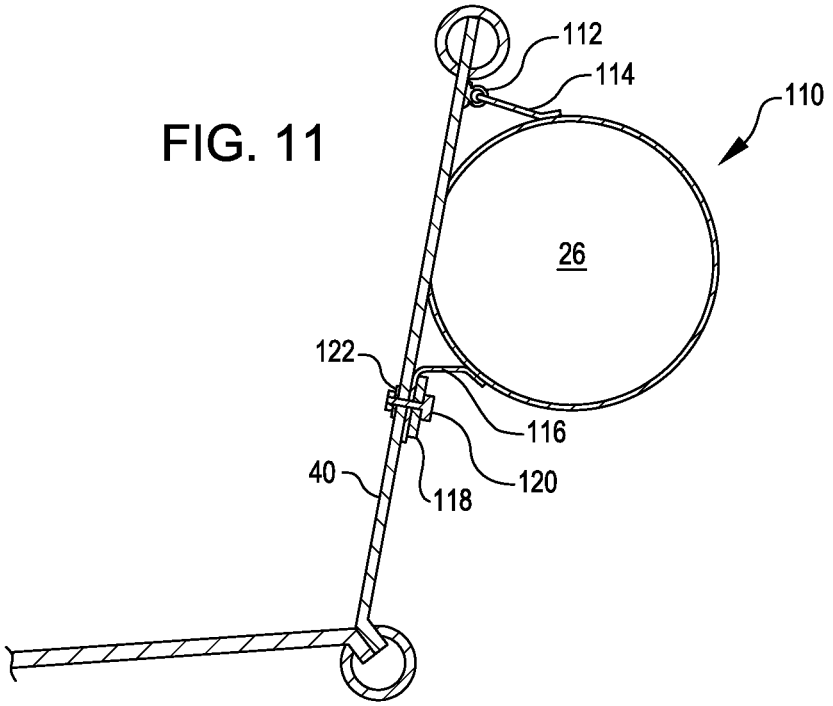
FIG. 11 is a cross-sectional view illustrating the attachment of an inflatable exterior assembly to a starboard-side hull panel at a non-seat location, in accordance with many embodiments.

FIG. 11 through FIG. 23 illustrate configuration details and installation steps for an inflatable exterior assembly 110, in accordance with many embodiments. FIG. 11 is a cross-sectional view illustrating the connection between the inflatable exterior assembly 110 and the starboard-side panel 40 at a non-seat location (e.g., at a location without a corresponding inflatable transverse interior member 18). The top of the inflatable exterior member 26 is attached to the starboard-side panel 40 via an attachment extrusion 112 and a bolt rope 114. The bolt rope 114 includes an edge rope that is slidingly received by the attachment extrusion 112 and a membrane the couples the edge rope with the top of the inflatable exterior member 26. At the bottom end of the inflatable exterior member 26, a lower tube flap 116 is used to couple the inflatable exterior member 26 with the starboard-side panel 40. A plate 118 and a bolt 120 are used to attach the lower tube flap 116 to the starboard-side panel 40. A fender washer 122 is used on the interior side of the starboard-side panel 40 to distribute the clamping force of the bolt 120 over an area of the starboard-side panel 40. In many embodiments, two bolts 120 are used to attach each lower tube flap 116 to the collapsible hull.

Figure 12:
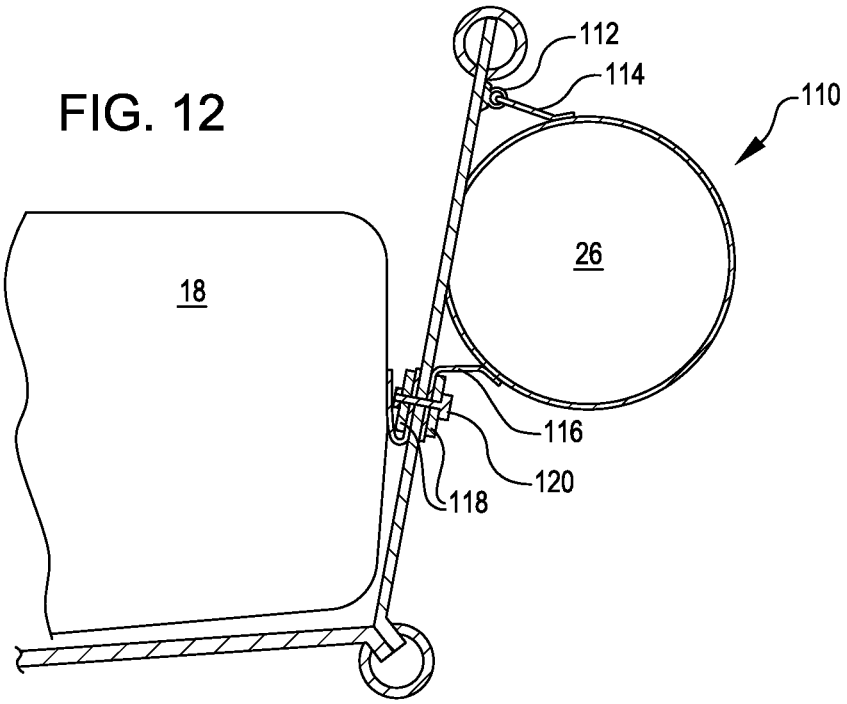
FIG. 12 is a cross-sectional view illustrating the attachment of an inflatable exterior assembly to a starboard-side hull panel at an inflatable transverse member location, in accordance with many embodiments.

FIG. 12 is a cross-sectional view illustrating the connection between the inflatable exterior assembly 110 and the starboard-side panel 40 at a seat location (e.g., at a location with a corresponding inflatable transverse interior member 18). The details of the connection are similar to those shown in FIG. 11, but with the fender washers 122 being replaced by an attachment plate 118 used to attach an attachment flap of the inflatable transverse interior member 18 with the starboard-side panel 40.

Figure 13:
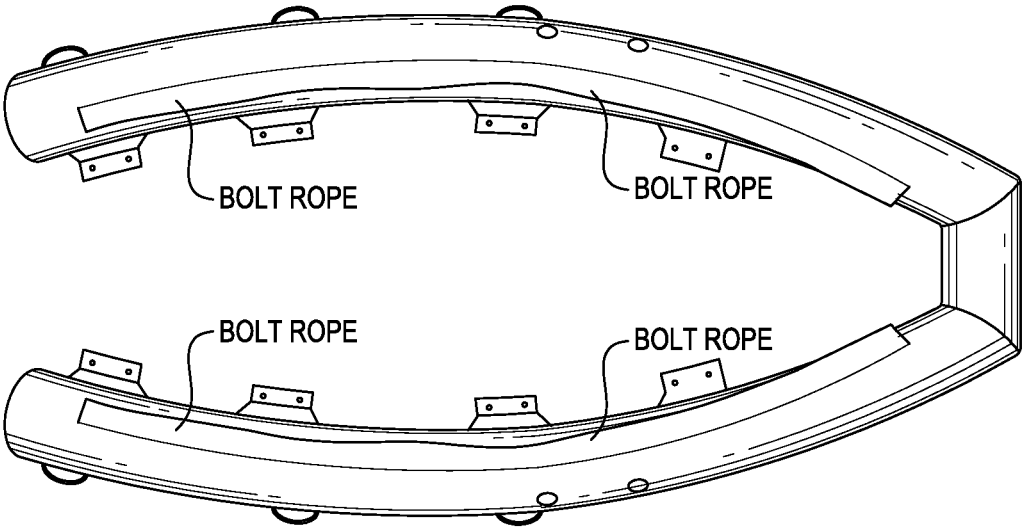
FIG. 13 illustrates an inflatable exterior assembly and shows the location of starboard-side and port-side bolt ropes that connect the top side of the inflatable exterior tube with the port-side and starboard-side hull panels, in accordance with many embodiments.
Figure 14:
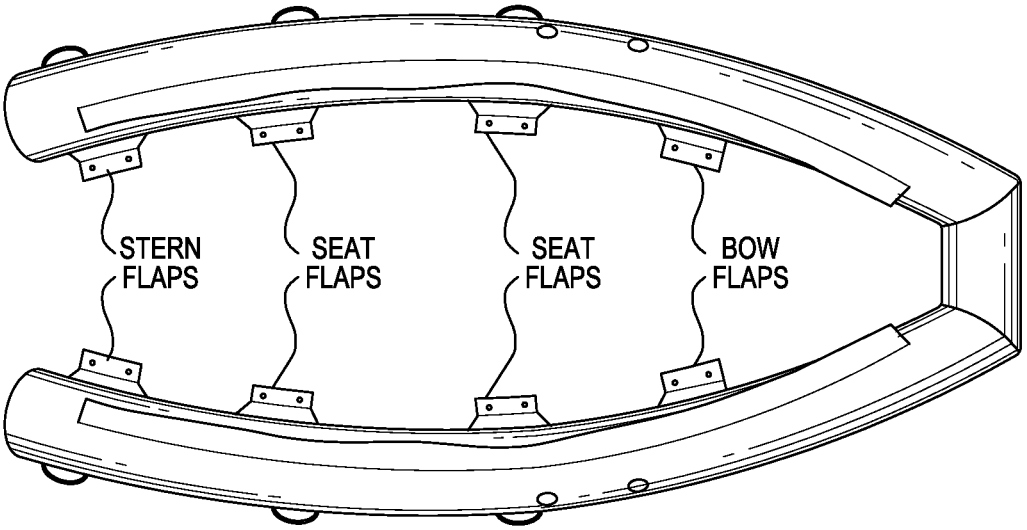
FIG. 14 illustrates an inflatable exterior assembly and shows the location of starboard-side and port-side lower tube flaps that connect the bottom side of the inflatable exterior tube with the port-side and starboard-side hull panels, in accordance with many embodiments.

FIGS. 13 and 14 illustrate the configuration of attachment features of the inflatable exterior assembly 110. For the attachment of the upper end of the inflatable exterior member 26 to the collapsible hull, port-side and starboard-side bolt ropes extend from just adjacent the stern of the inflatable exterior assembly to a location aft of the bow end of the inflatable exterior assembly. For the attachment of the lower end of the inflatable exterior member 26 to the collapsible hull, four port-side lower tube flaps and four starboard-side lower tube flaps are distributed as shown. The port-side and starboard-side lower tube flaps include stern flaps, seat flaps, and bow flaps.

Figure 15:
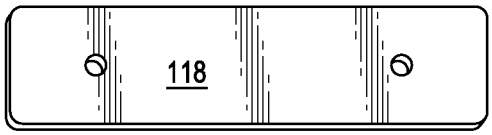
FIG. 15 illustrates an attachment plate used to attach lower tube flaps and inflatable transverse member attachment flaps to a hull panel, in accordance with many embodiments.

FIG. 15 illustrates an attachment plate 118. In many embodiments, an attachment plate 118 is a 2 inch by 8 inch aluminum plate having two attachment holes separated by 5 inches.

Figure 16:
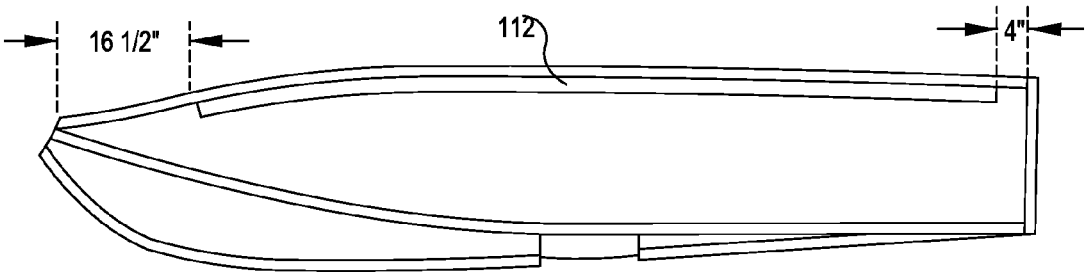
FIG. 16 illustrates the location of an attachment extrusion on a port-side hull panel for coupling with a port-side bolt rope, in accordance with many embodiments.

FIG. 16 illustrates the location of the attachment extrusion 112 on the port-side panel 38. In many embodiments, the attachment of the inflatable exterior assembly 110 to the collapsible hull begins with the attachment of the attachment extrusions 112 to the port and starboard sides of the collapsible hull. In the embodiment illustrated, the attachment extrusion 112 extends from four inches from the stern edge of the collapsible hull to sixteen and one-half inches from the front edge of the collapsible hull. The extrusion 112 can be riveted to the collapsible hull approximately every 4 inches starting 1 inch from each end. In many embodiments, the rivets are oriented to place their manufactured heads on the inside of the hull. The rivet length used can be minimized to reduce or eliminate any potential interference between the rivets and the bolt rope 114.

Figure 17:
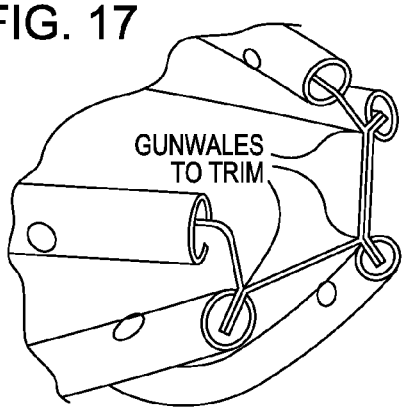
FIG. 17 illustrates gunwale members trimmed to avoid rubbing against an inflatable exterior assembly, in accordance with many embodiments.

FIG. 17 illustrates how the gunwale members of the collapsible hull can be trimmed to reduce or eliminate a potential rubbing against the back of the inflatable exterior assembly 110. While in many embodiments the back of the inflatable exterior assembly 110 is reinforced against rubbing damage, the illustrated end trim of the gunwale members can further help to avoid such rubbing damage.

Figure 18:
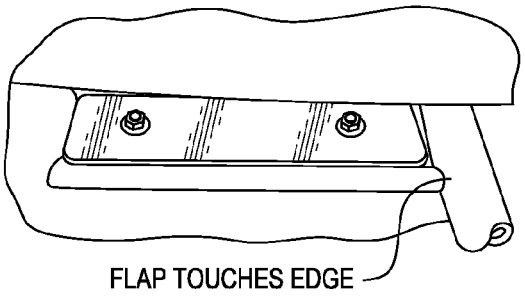
FIG. 18 illustrates the positioning of the inflatable exterior assembly relative to a stern end of the boat, in accordance with many embodiments.

After the installation of the attachment extrusions 112 to the collapsible hull and the trimming of the gunwale members, the attachment extrusions 112 can be lubricated with, for example, soap and water or a commercial lubricant prior to the installation of the port-side and starboard-side bolt ropes 114 into the attachment extrusions 112. The installation of the bolt ropes 114 into the attachment extrusions 112 starts at the bow of the collapsible hull and proceeds towards the stern of the collapsible hull until the stern lower tube flaps 116 are positioned adjacent the stern of the collapsible hull as illustrated in FIG. 18. The installation of the bolt ropes 114 into the attachment extrusions 112 can be accomplished by, for example, starting by sliding about one-half the length of a bolt rope along an attachment extrusion 112 on one side of the hull, and then switching to installing the other side bolt rope 114.

Figure 19:
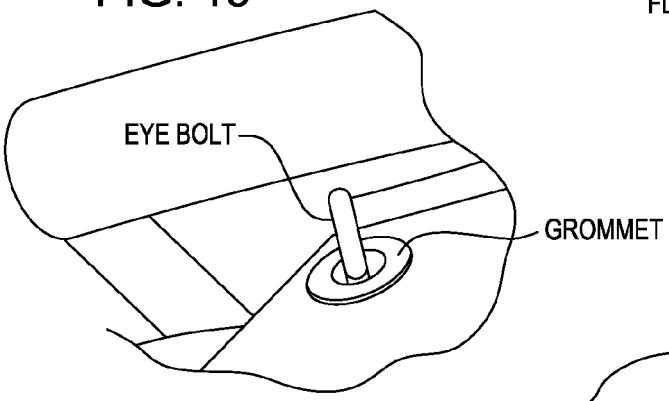
FIG. 19 illustrates the use of an eye bolt and a grommet at a stern end of a connection between a bolt rope of the inflatable exterior assembly and a hull panel, in accordance with many embodiments.

FIG. 19 illustrates the use of an eye bolt and a grommet to further secure the inflatable exterior assembly 110 to the collapsible hull. Port-side and starboard-side holes (e.g., for a one-quarter inch eye bolt) can be drilled in the collapsible hull and fender washers (not shown) can be used to distribute any clamping force over corresponding areas of the port-side and starboard-side hull panels. In many embodiments, the grommets are located adjacent to the port-side and starboard-side bolt ropes 114 at the stern end of the bolt ropes 114 and are attached to the membranes of the bolt ropes 114. These port-side and starboard-side eye bolt connections prevent the bolt ropes 114 from sliding out of the attachment extrusions 112.

Figure 20:
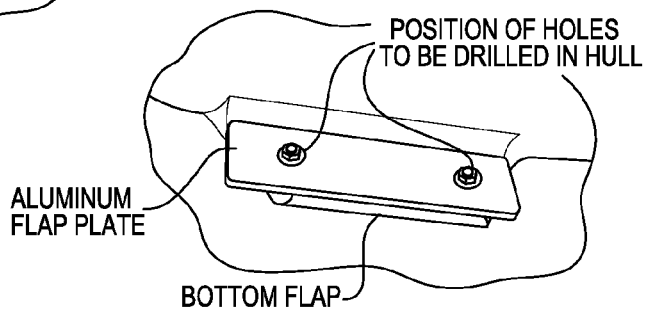
FIG. 20 illustrates the use of an attachment plate to attach a lower tube flap of the inflatable exterior assembly and a hull panel, in accordance with many embodiments.

When the inflatable exterior assembly 110 is in the correct fore/aft position, pre-located holes in the lower tube flaps 116 can be used to determine the location of corresponding mating holes in the collapsible hull. As illustrated in FIG. 20, the vertical position of the holes can be determined by pressing the lower tube flaps 116 against the hull using an attachment plate 118. The resulting vertical position of the holes can be compared with an expected separation from the attachment extrusion 112 such as, for example, approximately eight and one-half inch from the centerline of the attachment extrusion 112. The holes for the center two flaps are also used to attach the seat attachment flaps, so the suitability of these positions relative to the attachment of the seat attachment flaps can be verified prior to drilling the holes in the hull panels. These holes can be, for example, sized to be clearance holes for one-quarter inch bolts (e.g., five-sixteenths inch diameter, three-eighths inch diameter).

Figure 21:
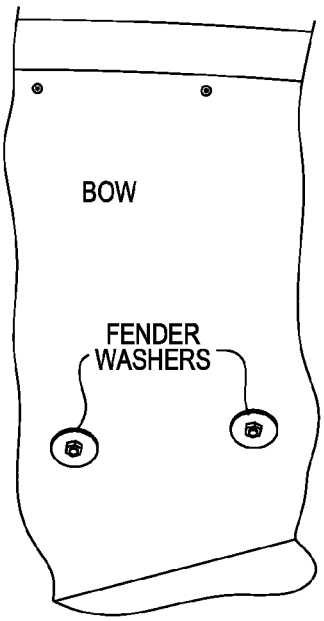
FIG. 21 illustrates the use of fender washers at non-transverse-member attachment locations between a lower tube flap of the inflatable exterior assembly and a hull panel, in accordance with many embodiments.
Figure 22:
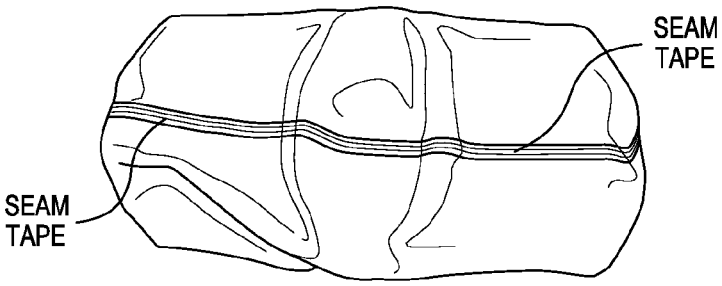
FIG. 22 illustrates a seam on an inflatable interior transverse member used to orient the inflatable interior transverse member during installation, in accordance with many embodiments.
Figure 23:
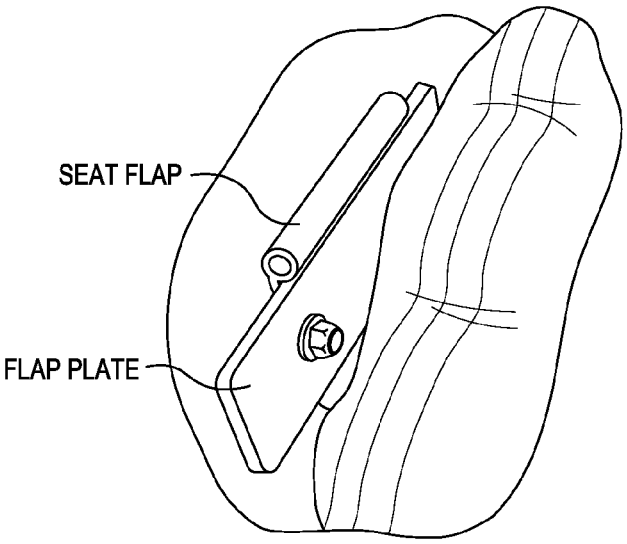
FIG. 23 illustrates a connection between an inflatable interior transverse member and a hull panel, in accordance with many embodiments.

In many embodiments, each lower tube flap 116 and each attachment flap for the inflatable transverse members 18 are attached to the collapsible hull by an attachment plate 118. In many embodiments, the attachment plates 118 are black anodized aluminum plates for resistance against oxidation. For the bow and stern lower tube flaps 116, the attachment bolts 120 are installed with washers through the holes in the attachment plate 118, through the holes in the lower tube flaps 116, through the holes in the hull panel, through the fender washers 112 (as shown in FIG. 21), and secured with self-locking nuts. For the two center lower tube flaps 116, a corresponding deflated inflatable transverse member 18 can be positioned opposite each lower tube flap 116 and can be oriented so that a seam (shown in FIG. 22) in the inflatable transverse member 18 faces the collapsible hull. One of the attachment plates 118 can be used to align the holes in the seat flaps with the holes in the hull, and an attachment bolt 120 with a regular washer installed can be inserted in each of these holes (resulting in the configuration illustrated in FIG. 23). On the exterior side of the hull panel, the lower tube flap 116 can be placed over the bolts, an attachment plate 118 placed over the lower tube flap 116, and secured with regular washers and self-locking nuts. In many embodiments, stainless steel hex head bolts are used as the attachment bolts 120, and their length(s) selected to minimize excess bolt length beyond the nut to reduce or eliminate possible chafing of the exterior inflatable assembly 110.

Folding Transoms

FIG. 24 through FIG. 34 illustrate embodiments of folding rigid transoms that can be used in conjunction with a boat having a collapsible hull. In many embodiments, the folding rigid transom remains attached to the hull when the hull is in the collapsed configuration, and is rotated into a deployed configuration to constrain rear margins of panels of the collapsible hull when the hull is in the expanded configuration, thereby simplifying the process by which the boat is reconfigured from the collapsed configuration into the expanded configuration, and vice-versa.

FIG. 24 illustrates a collapsible boat 130 in an expanded configuration. The boat 130 includes a collapsible hull and a folding rigid transom 132. The folding rigid transom 132 is rotationally coupled with a starboard side panel 134 of the collapsible hull and is shown in a deployed configuration in which the transom 132 is releaseably coupled to a port side panel 136 of the collapsible hull. The coupling between the port side panel 136 and the transom 132 secures the transom in place relative to the port and starboard side panels 136, 134. When in the deployed configuration, the folding rigid transom 132 constrains rear margins of the port and starboard side panels 136, 134 when the hull is in the expanded configuration. And when the boat is in the collapsed configuration, the folding rigid transom 132 is sandwiched between a side panel and a bottom panel of the collapsible hull.

The folding rigid transom 132 includes a transom member 138 and an articulated motor mount 140. The motor mount 140 is rotationally coupled to the transom member 138. The motor mount 140 can be placed in a raised configuration, which avoids interfering with a flexible diaphragm (such as the flexible diagraph 58 of FIG. 3) connected with the rear margins of the panels of the collapsible hull when the folding rigid transom 132 is rotated back into its deployed configuration. Once the folding rigid transom 132 reaches its deployed configuration, the motor mount 140 can then be rotated down into a vertical orientation, thereby trapping a portion of the flexible diaphragm between the motor mount 140 and the transom member 138.

FIG. 25 illustrates details of the folding rigid transom 132 and the connections between the folding rigid transom 132 and the port and starboard side panels of the collapsible hull. The transom member 138 is rigid and includes a transverse flat web 142, port and starboard side flanges 144, 146 attached to the web 142, and transverse flanges 148, 150 attached to the web 142 and the side flanges 144, 146. The transom member 138 can be fabricated from any suitable material (e.g., a suitable alloy of aluminum such as a 5000 or 6000 series aluminum alloy, a suitable stainless steel, a suitable composite material). The transom member 138 can be fabricated as a welded assembly and/or a built-up assembly (e.g., separate stiffening elements fastened and/or welded to a web).

The transom member 138 provides a rigid column that maintains a predetermined separation between the port and starboard side panels of the collapsible hull consistent with the expanded configuration of the hull. In the expanded configuration, the flexible diaphragm assumes a substantially flat configuration and serves to help constrain the port and side panels, thereby maintaining contact between the transom member 138 and the port and side panels of the collapsible hull, respectively. The port side flange 144 provides a port side surface 152 that is configured to interface with the port side panel 136 when the hull is in the expanded configuration. Likewise, the starboard side flange 146 provides a starboard side surface 154 that is configured to interface with the starboard side panel 134 when the hull is in the expanded configuration.

The transom member 138 is rotationally coupled with the starboard side panel 134 via a first hinge 156 and a second hinge 158. The first and second hinges 156, 158 provide a common hinge line 160 about which the transom member 138 rotates relative to the starboard side panel 134. The first hinge 156 includes a first member **156*a* that is attached to the starboard side panel 134 and a second member 156*b* that is attached to the starboard side flange 146. The second hinge 158 includes a third member 158*a* that is attached to the starboard side panel 134 and a fourth member 158*b* that is attached to the starboard side flange 146. The first member 156*a* has a hinge pin that extends downward and is received by the second member 156*b*. The third member 158*a* has a hinge pin that extends upward and is received by the fourth member 158*b*. The second member and fourth members 156*b*, 158*b* are thereby trapped between the first and third members 156*a*, 158*a*, thereby ensuring that the transom member 138 remains attached to the starboard side panel 134 when the hull is in the collapsed configuration. In an alternate embodiment, the second and fourth members 156*b*, 158*b* are attached to the starboard side panel 134 and the first and third members 156***a*, 158*a* are attached to the starboard side flange 146.

Figure 27:
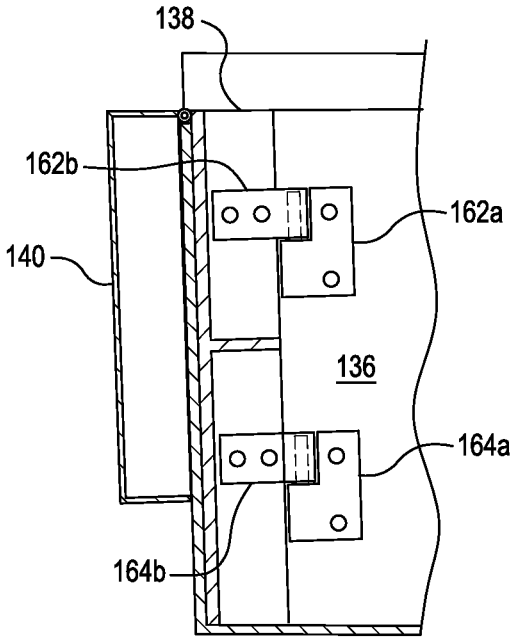
FIG. 27 is a side view illustrating the port side releasable coupling of FIG. 24.

The transom member 138 is releaseably connected to the port side panel 136 via a third hinge 162 and a fourth hinge 164, which serve as a releasable connector. The third hinge 162 includes a fifth member 162*a* and a sixth member 162*b*. And the fourth hinge 164 includes a seventh member 164*a* and an eighth member 164*b*. The fifth and seventh members 162*a*, 164*a* are attached to the port side panel 136 and each include a hinge pin that extends upward and can be releaseably received by the sixth and eighth members 162*b*, 164*b*, respectively. When the hull is reconfigured into the expanded configuration, the transom member is swung into its deployed position and is maneuvered such that the sixth and eighth members 162*b*, 164*b* engage and receive the hinge pins of the fifth and seventh members 162*a*, 164*a*. FIG. 27 provides a cross-sectional view that further illustrates components of the foldable rigid transom 132 and the releasable connection between the transom member 138 and the port side panel 136.

Figure 26:
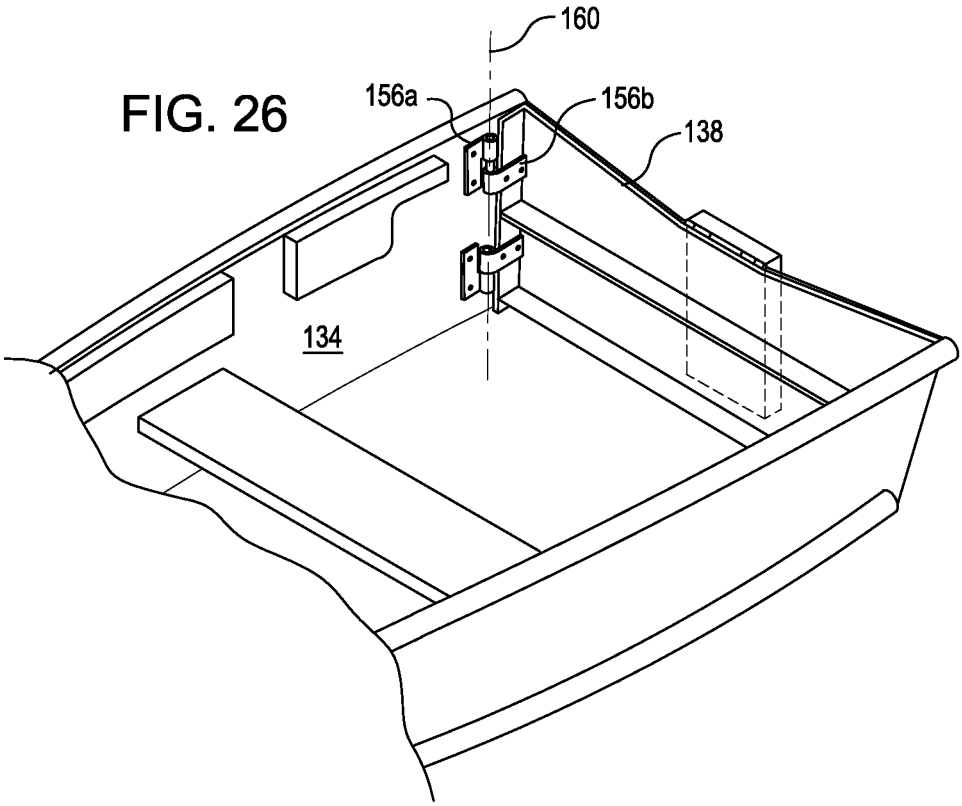
FIG. 26 is another perspective view illustrating the boat of FIG. 24, showing a starboard side coupling between the folding rigid transom and a starboard side panel of the collapsible hull, in accordance with many embodiments.

FIG. 26 illustrates an embodiment in which the first and second hinges 156, 158 are installed to allow a predetermined amount of translation of the transom member 138 along the common hinge line 160. As shown, the second member 156*b* of the first hinge is offset by the predetermined distance below the first member 156*a* of the first hinge, thereby providing an attachment that allows the transom member 138 to be translated along the common hinge line 160 relative to the hull by the predetermined amount, while also providing a rotational coupling between the transom member 138 and the starboard side panel 134 that remains attached when the hull is in the collapsed configuration. In many embodiments, the predetermined amount of translation is selected and used to facilitate the engagement of the hinge pins of the fifth and seventh members 162*a*, 164*a* by the sixth and eighth members 162*b*, 164*b* by allowing the transom member 138 to be lifted relative to the hull, rotated relative to the hull about the common hinge line 160 to align the hinge pins of the fifth and seventh members 162*a*, 164*a* with the sixth and eighth members 162*b*, 164*b*, and the lowered relative to the hull thereby inserting the hinge pins of the fifth and seventh members 162*a*, 164*a* into the sixth and eighth members 162*b*, 164*b*. FIG. 27 shows the hinge pins of the fifth and seventh members 162*a*, 164*a* as fully inserted into the sixth and eight members 162*b*, 164*b*.

Figure 28:
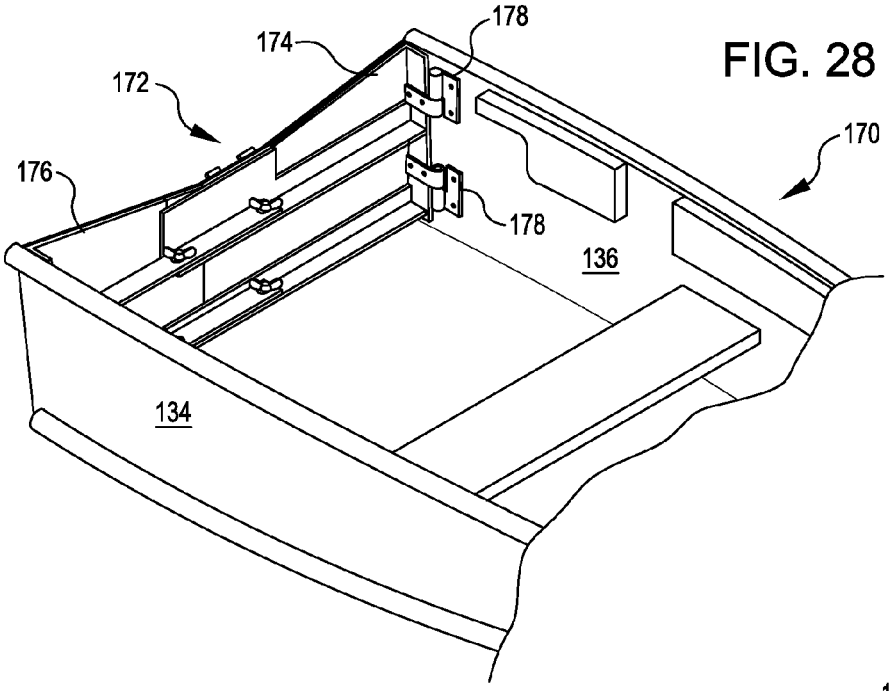
FIG. 28 is a perspective view illustrating a boat that includes a collapsible hull and a two-section folding rigid transom, showing a releasable coupling between port and starboard sections of the folding rigid transom, in accordance with many embodiments.
Figure 29:
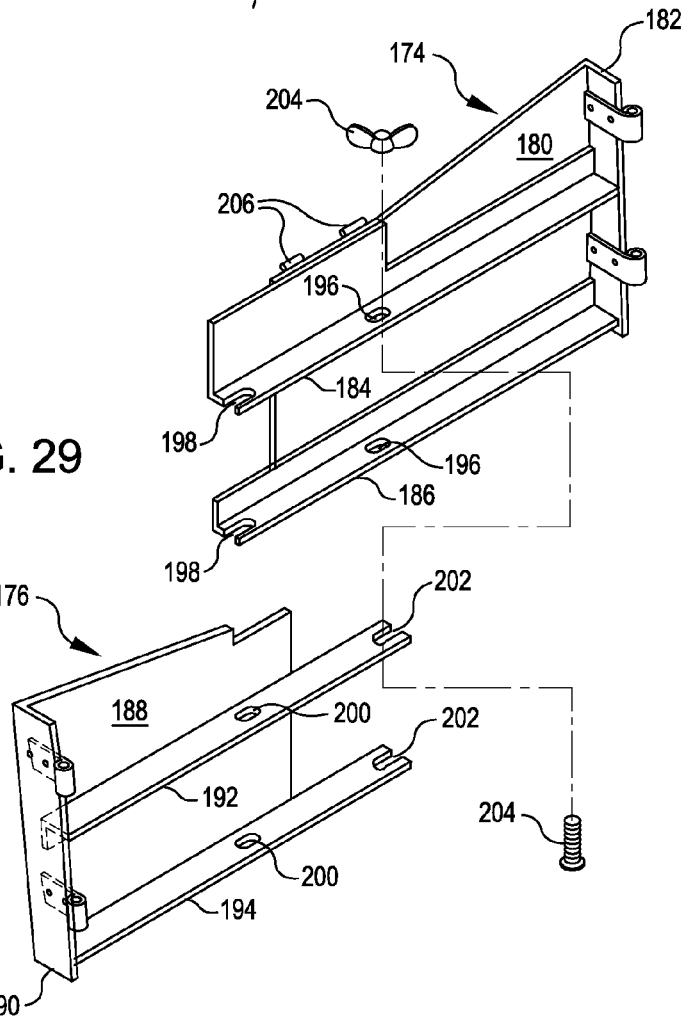
FIG. 29 is an exploded perspective view illustrating the two-section folding rigid transom of FIG. 28.

FIG. 28 and FIG. 29 illustrate a boat 170 that includes a collapsible hull and a two-section folding rigid transom 172, in accordance with many embodiments. The two-section folding rigid transom 172 includes a port side section 174 that is rotationally coupled with the port side panel 136 and a starboard side section 176 that is rotationally coupled with the starboard side panel 134. The port side section 174 remains attached to the port side panel 136 when the hull is in the collapsed configuration. And the starboard side section 176 remains attached to the starboard side panel 134 when the hull is in the collapsed configuration. Hinges 178 are used to rotationally couple the port side section 174 to the port side panel 136. And hinges are similarly used to rotationally couple the starboard side section 176 to the starboard side panel 134. The port side section 174 includes a flat web 180, a port side flange 182 that is attached to the flat web 180, and two transverse stiffeners 184, 186 that are attached to the web 180 and the port side flange 182. The starboard side section 176 includes a flat web 188, a starboard side stiffener 190 attached to the flat web 188, and two transverse stiffeners 192, 194 attached to the web 188 and the starboard side stiffener 190. The port side transverse stiffeners 184, 186 include elongated holes 196 and slots 198 that are positioned to align with corresponding elongated holes 200 and slots 202 in the starboard side transverse stiffeners 192, 194 when the port and starboard side sections 174, 176 are positioned to constrain the hull panels when the hull is in the expanded configuration. Removable fasteners 204 are used to secure the port and starboard side sections 174, 176 to each other. The port side section 174 includes coupling features 206 by which a motor mount, such as the motor mount 140 describe above, can be rotationally and/or removably coupled to the port side section 174. When the boat is in the collapsed configuration, the port and starboard side sections 174, 176 are sandwiched between respective side and bottom panels of the collapsible hull.

Figure 30:
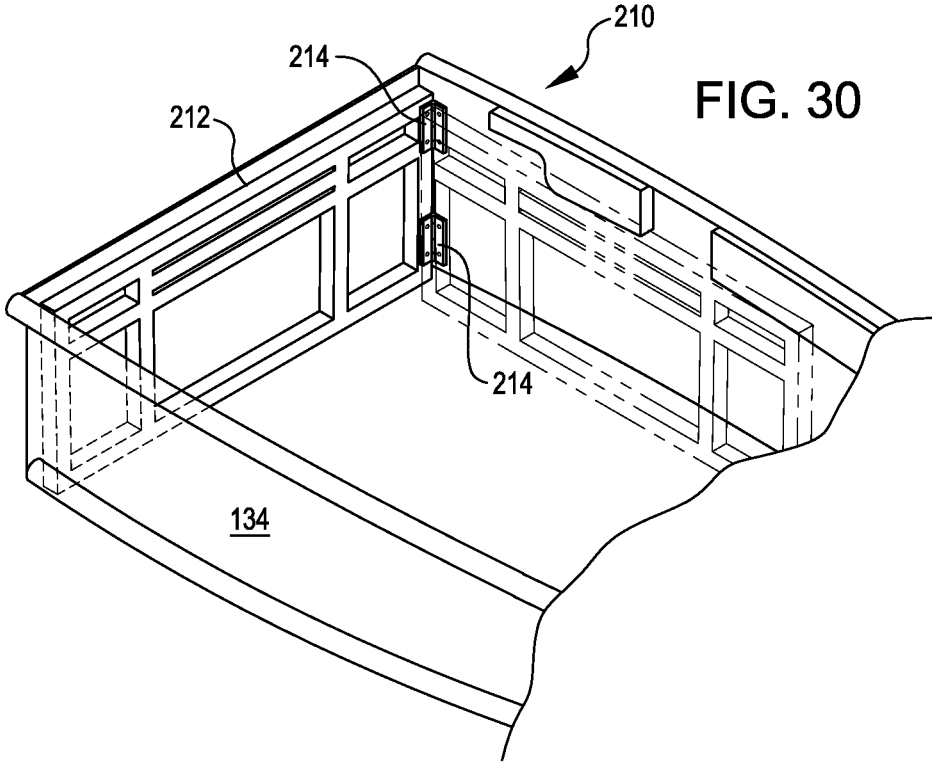
FIG. 30 is a perspective view illustrating a boat that includes a collapsible hull and a folding rigid transom having a frame configuration, showing a port side coupling between the folding rigid transom and a port side panel of the collapsible hull, in accordance with many embodiments.
Figure 31:
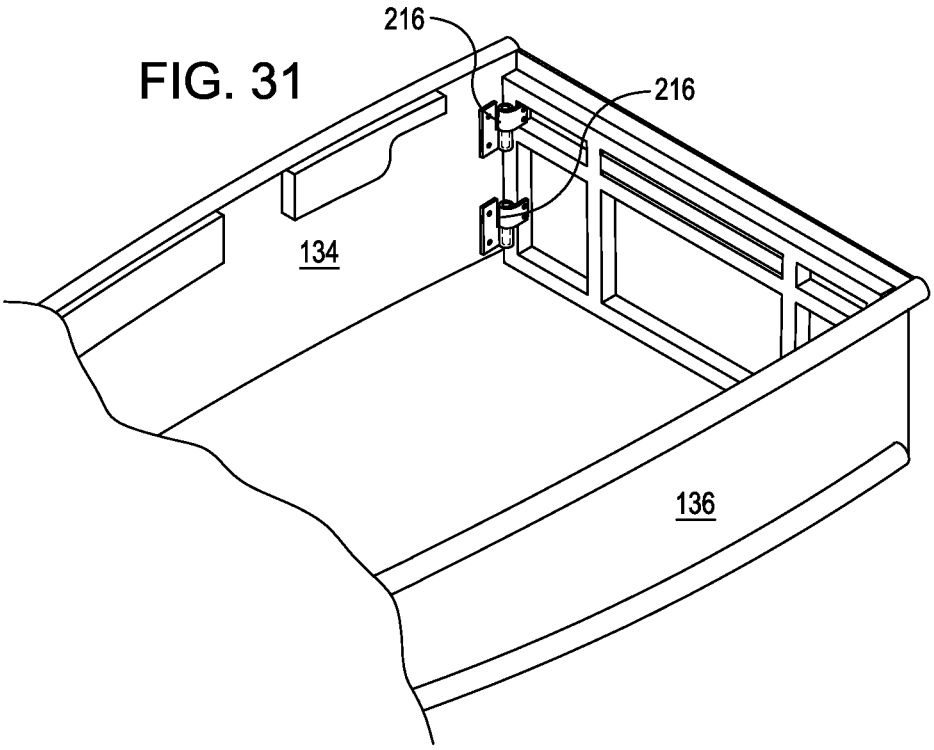
FIG. 31 is another perspective view illustrating the boat of FIG. 30, showing a starboard-side releasable coupling between the folding rigid transom and a starboard side panel of the collapsible hull, in accordance with many embodiments.

FIG. 30 and FIG. 31 illustrate a boat 210 having a collapsible hull and a folding rigid transom 212 having a frame configuration, in accordance with many embodiments. The rigid transom 212 includes transverse frame members, a port-side frame member, a port-side intermediate frame member, a starboard-side intermediate member, and a starboard-side frame member. Hinges 214 rotationally attach the port side frame member to the port side panel 136. And a releasable connector 216 is used to releaseably couple the starboard-side frame member to the starboard-side panel 134.

Figure 32:
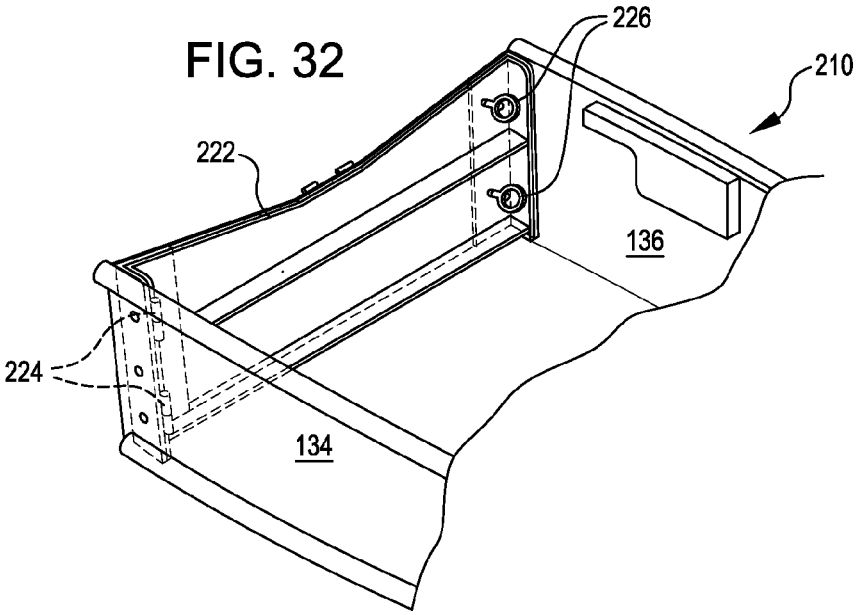
FIG. 32 is a perspective view illustrating a boat that includes a collapsible hull and a folding rigid transom that is secured via a releasable connector that includes reconfigurable latch members, in accordance with many embodiments.
Figure 33:
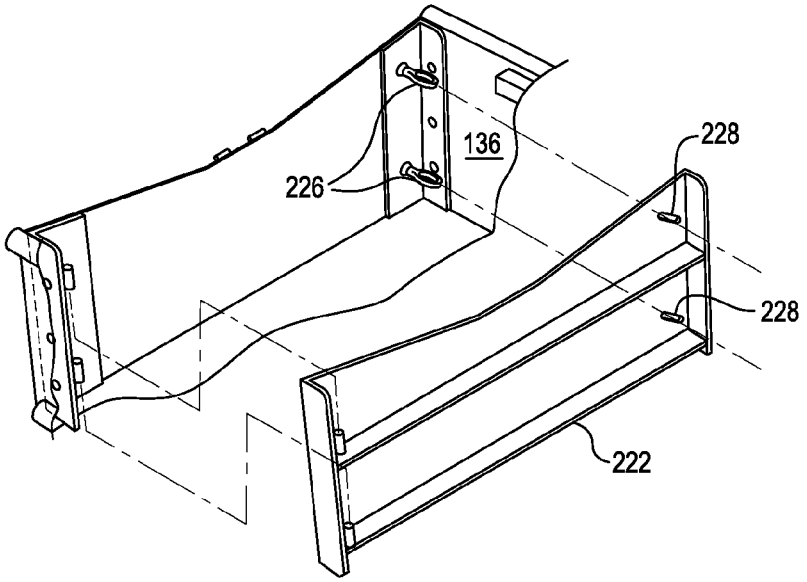
FIG. 33 is an exploded perspective view of the collapsible hull and the folding rigid transom of FIG. 32.
Figure 34:
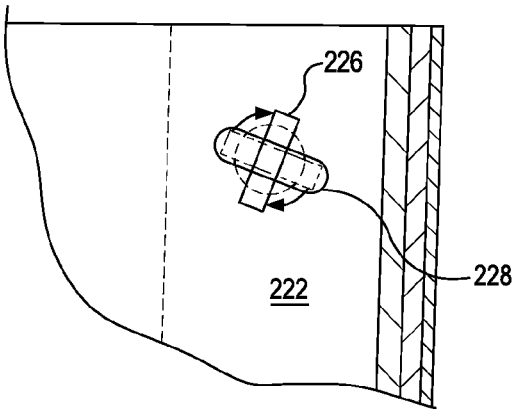
FIG. 34 is a side view illustrating reconfiguration of a latch member to secure the folding rigid transom of FIG. 32 relative to the panels of the collapsible hull, in accordance with many embodiments.

FIG. 32, FIG. 33, and FIG. 34 illustrate a boat 220 having a collapsible hull and a folding rigid transom 222, in accordance with many embodiments. The folding rigid transom 222 is rotationally coupled with the starboard panel 134 of the collapsible hull via hinges 224. The folding rigid transom 222 remains attached to the starboard side panel 134 when the hull is in the collapsed configuration. Releasable connectors 226 that include reconfigurable latch members are fixedly attached to the port side panel 136. The folding rigid transom 222 is rotatable into a deployed position, where the reconfigurable latch members are received through slots 228 in the folding rigid transom 222 and extend there through. As illustrated in FIG. 34, the reconfigurable latch members can be rotated into a position that secures the folding rigid transom by engaging the folding rigid transom 222 adjacent to the slots ss8, thereby preventing movement of the folding rigid transom 222 relative to the panels of the collapsible hull.

Figure 35:
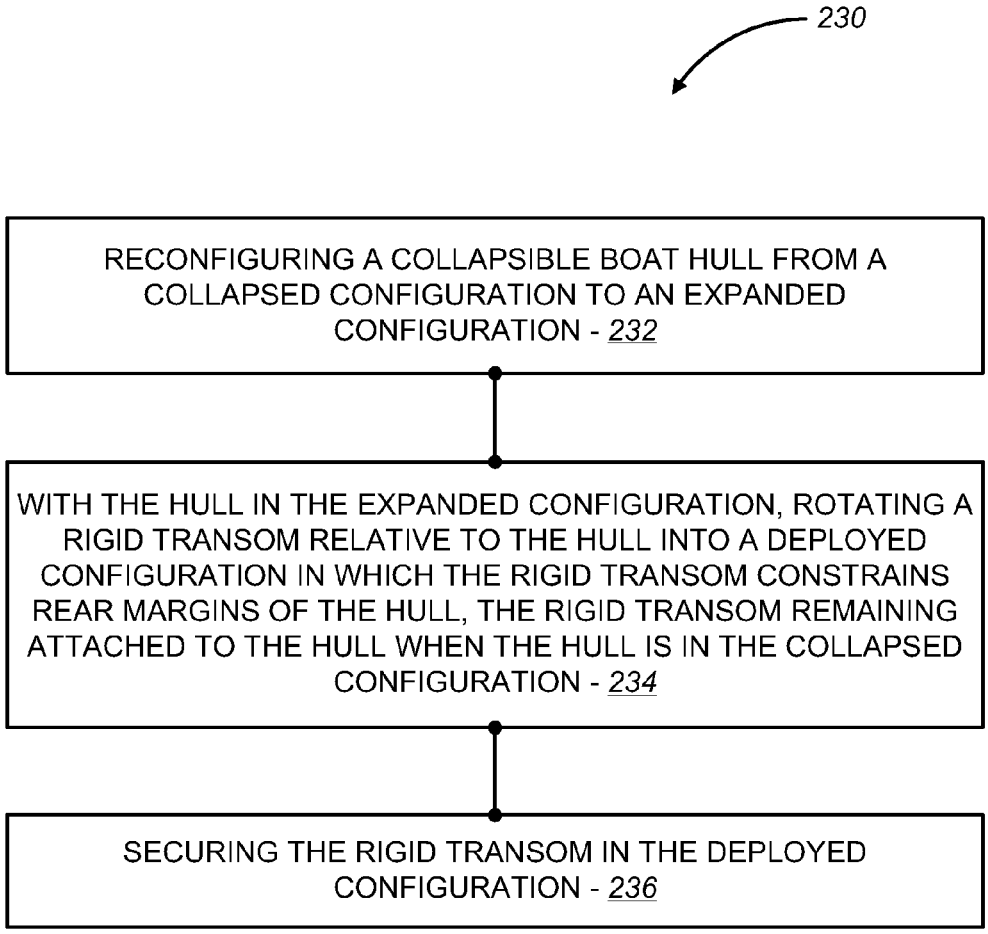
FIG. 35 is a simplified diagram listing acts of a method for expanding a collapsible boat hull, in accordance with many embodiments.

FIG. 35 lists acts of a method 230 for expanding a collapsible boat hull, in accordance with many embodiments. The method 230 can be accomplished using any suitable collapsible boat hull having a folding rigid transom that remains attached to the hull when the hull is in a collapsed configuration, such as those described herein. The method includes reconfiguring a collapsed boat hull from a collapsed configuration to an expanded configuration (act 232); with the hull in the expanded configuration, rotating a rigid transom relative to the hull into a deployed configuration in which the rigid transom constrains rear margins of the hull, the rigid transom remaining attached to the hull when the hull is in the collapsed configuration (act 234); and securing the rigid transom in the deployed configuration (act 236).

Additional embodiments herein are directed to a folding boat having a folding transom, as described above, and additionally including a brace that attaches to the folding transom when the folding transom is in the deployed configuration. The brace can be anchored anywhere in the boat, such as the sides, bottom, a seat, or any other structure on the boat. The brace is preferably formed of a material that resists tension and compression, such as steel, wood, or sturdy plastic. The brace can be utilized to minimize deflection of the transom, once deployed. Thus, the transom has additional rigidity for receiving a motor, or to respond to motor or water conditions.

In embodiments, the transom brace can be attached anywhere to the folding transom so that support is provided for the folding transom. In embodiments where a folding transom is attached at one side of the boat by a hinge, the brace would be attached at a location on the folding transom removed from the hinge, such as at an opposite end of the folding transom. If two panels are used for a folding transom, such as in the embodiments shown in FIG. 28, then a brace can be located centrally. In addition, for all embodiments, more than one brace can be provided.

Figure 36:
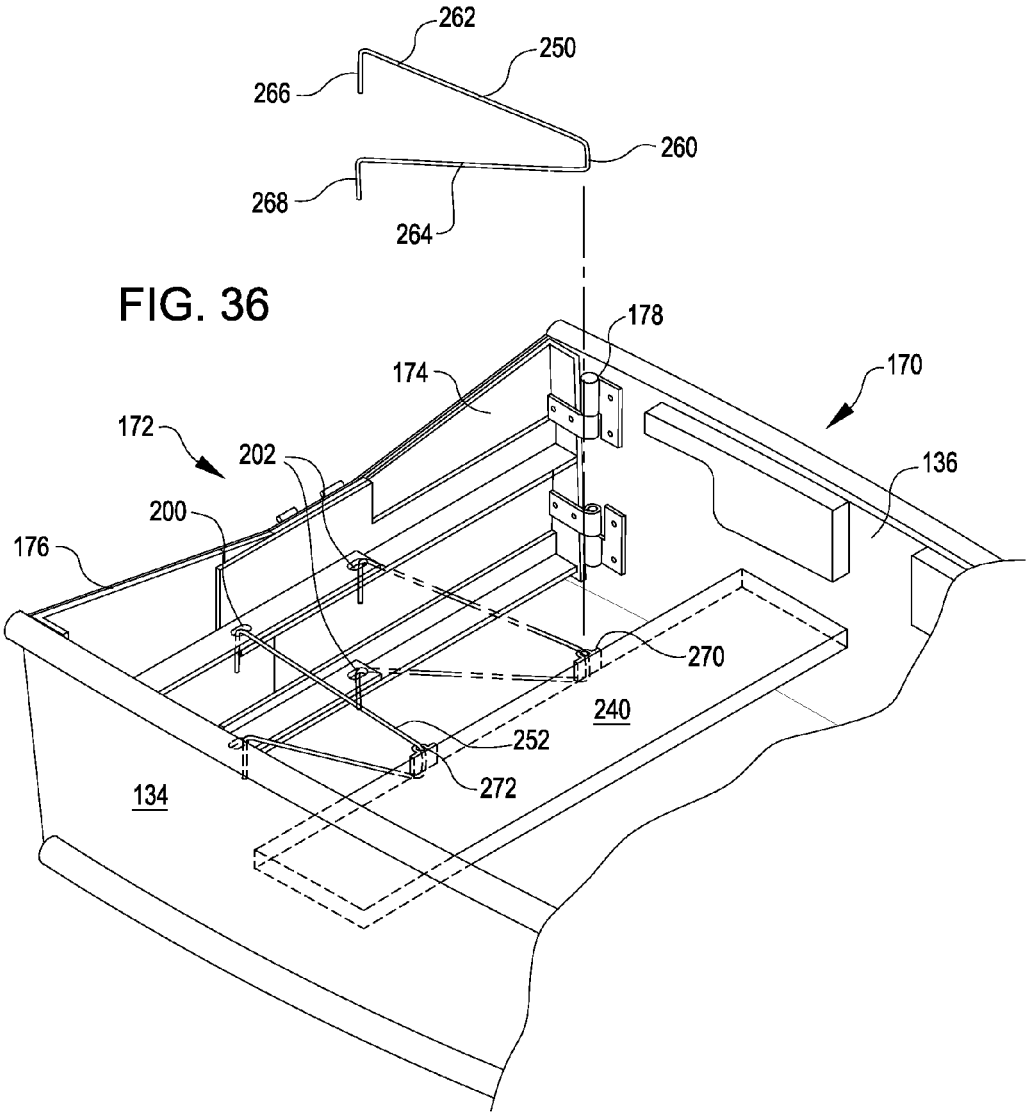
FIG. 36 is a partial cutaway, perspective view of a rear end of a foldable boat that utilizes a brace that attaches between a seat and a transom board in accordance with embodiments.

In accordance with additional embodiments, the brace can be used to connect the folding transom to the boat or to connect folding transom panels. For example, as shown in FIG. 36, the boat 170, described with respect to FIG. 28, utilizes a pair of braces 250, 252 that are attached to the back of a seat 240. In this embodiment, the braces 250, 252 not only provide rigid support for the folding transom 172, but also attach the two panels 174, 176 to each other. To provide this function, ends of the braces 250, 252 replace the fasteners 204 in the previous embodiments, as is further described below. For ease of description, the single brace 250 is described below, but the features of the brace 250 can be included with the brace 252, or the two could be configured differently. In addition, in embodiments, a single brace could be used.

The brace 250 includes a front, vertical section 260 attached to two legs 262, 264. The legs extend to a pair of downwardly-extending tabs 266, 268. In an embodiment, the entire brace 250 is formed of a single piece of metal that is bent into shape. However, braces can be formed of multiple pieces and/or can be molded or formed into a particular configuration.

The brace 250 is connected to a bracket 270 mounted on the back of the seat 240. Similarly, the brace 252 is attached to a bracket 272 also mounted on the back of the seat 240. Each of the brackets 270, 272 includes a vertically-aligned sleeve for receiving the vertically extending forward portion 260 of the braces 250, 252. The vertically-aligned sleeve allows the brace 250 to rotate about the forward portion 260. In this manner, the braces 250, 252 can be rotated and stored against the back or side of the seat, and, when the boat 170 is deployed, the brace may be aligned and attached to the folding transom 172.

In embodiments, the brace 250 is formed of a flexible, yet resilient, material, such as steel. The flexible resiliency of the brace 250 permits the brace to flex without bending, and urges the brace in a spring-like manner back to its original configuration. Thus, the brace 250 can be rotated to align with the openings 202 and the tabs 266, 268 can be moved, via the flexible nature of the brace, to the proper location to connect the brace 250 to the folding transom 172. In this position, the spring nature of the brace 250, as well as gravity, maintains the tabs 266, 268 in the openings 202. Similarly, the tabs for the brace 252 fit within and are maintained within the openings 200. The tabs prevent the two panels from moving apart by connecting the panels. Moreover, the rigid nature of the braces 250, 252 prevents movement back and forth of the folding transom 172 relative to the seat 240.

Figure 37:
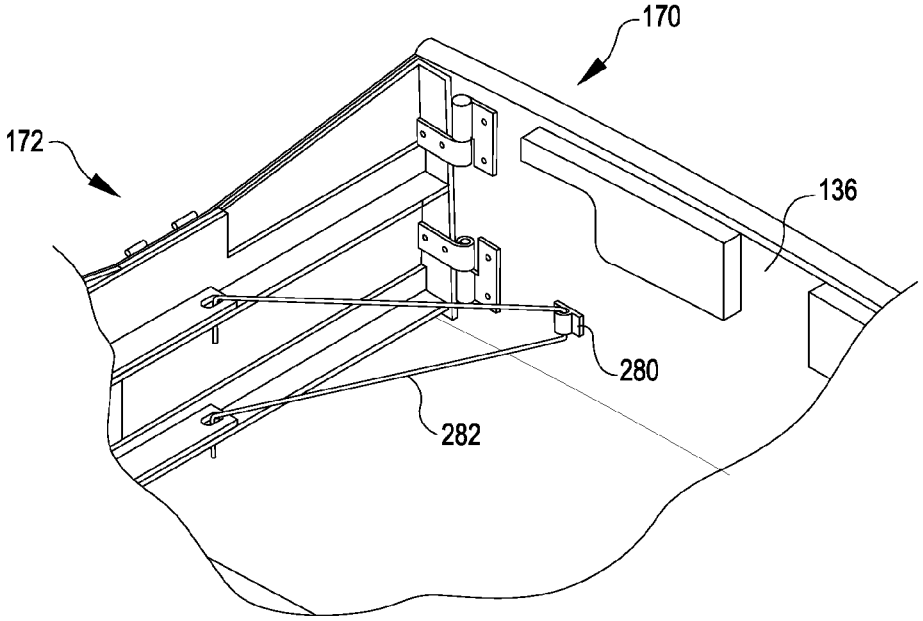
FIG. 37 is a partial cutaway, perspective view of a rear end of an alternative embodiment of a foldable boat with a brace that attaches between a sidewall of the boat and the transom.
Figure 38:
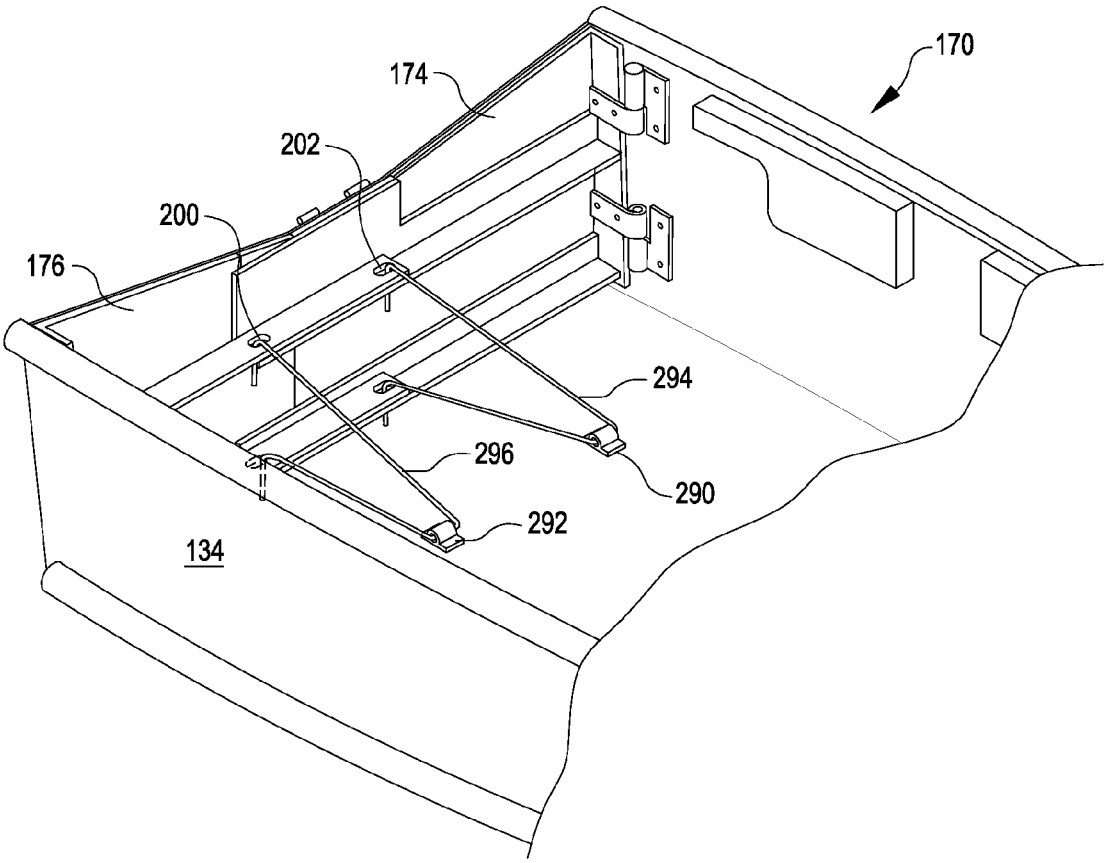
FIG. 38 is a partial cutaway, perspective view of a rear end of an alternative embodiment of a foldable boat with a brace that attaches between a floor of the boat and the transom.
Figure 39:
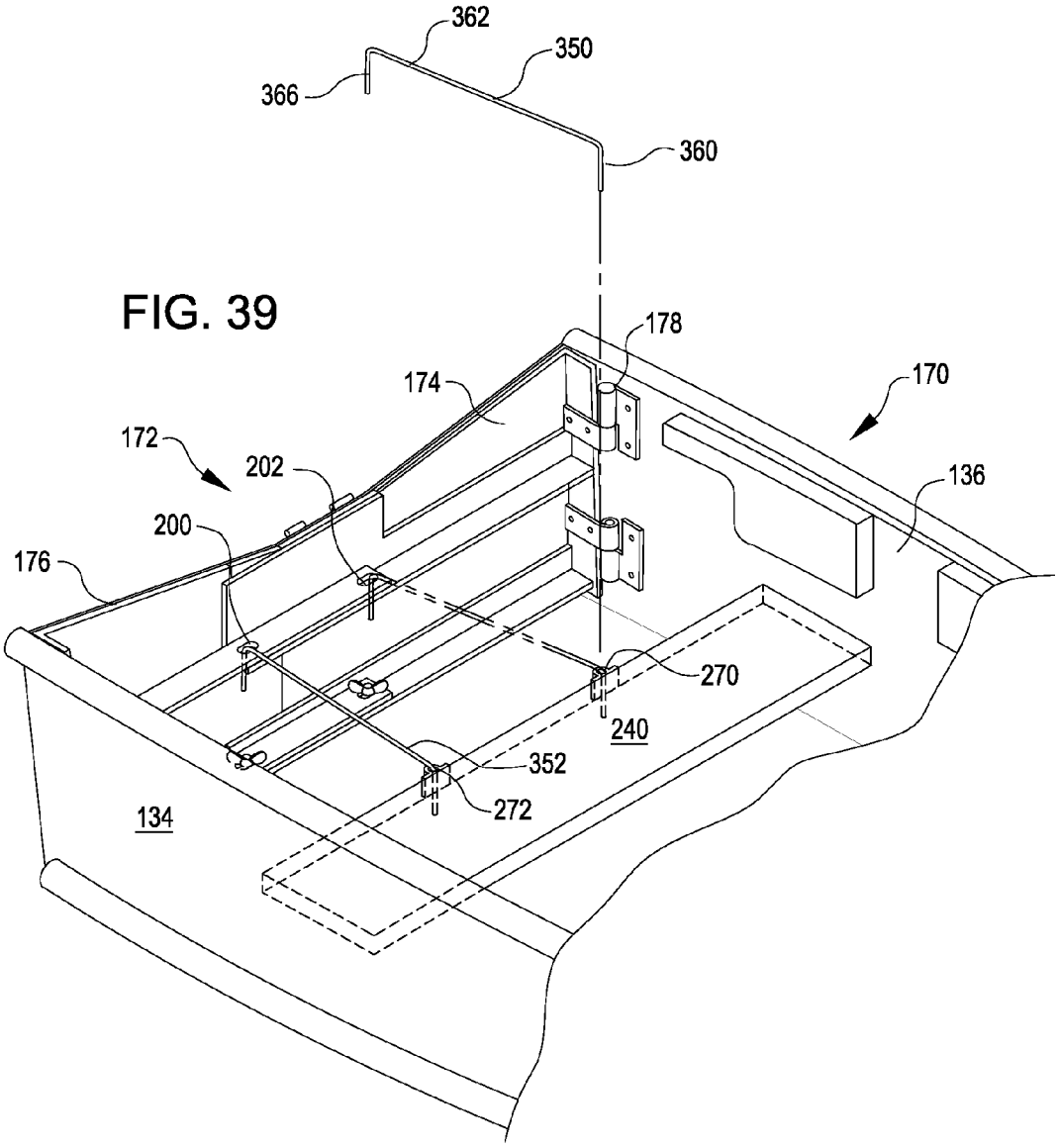
FIG. 39 is a partial cutaway, perspective view of a rear end of an alternative embodiment of a foldable boat with a brace that attaches between a seat of the boat and the transom.

Alternate embodiments could be utilized. For example, FIG. 37 shows an embodiment in which a bracket 280 is mounted on the side 136 of the boat 170, yet provides a similar function to the bracket 250. In still another embodiment, FIG. 38 shows brackets 290, 292 mounted on a bottom of the boat 170 and attached to the folding transom 174. FIG. 39 shows a brace 350, having two tabs 360, 366 separated by a main body 362. The two tabs 360, 366 extend into the bracket 270, and the opening 202, respectively. Similarly, a brace 352 attaches between the bracket 272 and the opening 200. In this embodiment, the braces 350, 352 do not extend to the bottom openings, and the bottom openings are connected by fasteners.

Figure 40:
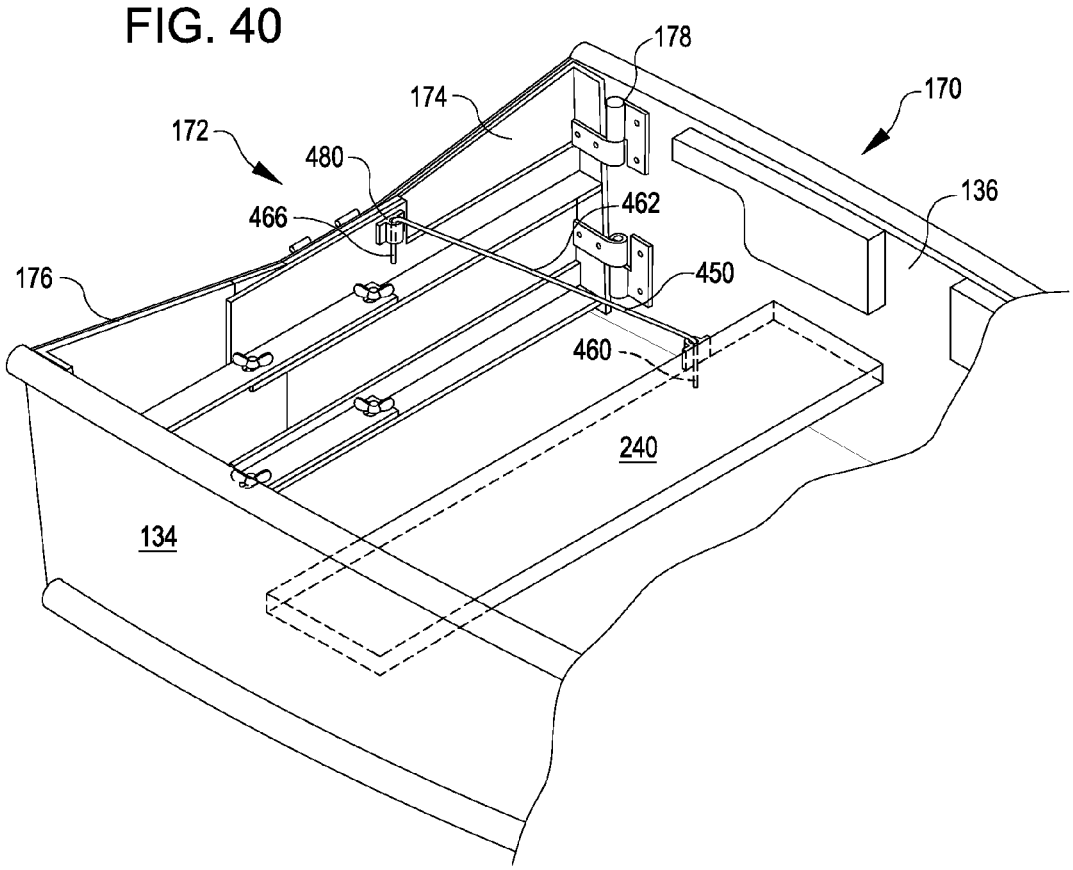
FIG. 40 is a partial cutaway, perspective view of a rear end of an alternative embodiment of a foldable boat with two braces that attach between a seat of the boat and the transom.

As another alternative, FIG. 40 shows yet another embodiment where a brace 450 extends between a back of the seat 240 and to a top portion of the transom 172. The brace 450 includes tabs 460, 466, that extend into brackets on the seat 240 and the transom 172 (see bracket 480). This brace 450 is offset relative to center to permit a motor to be mounted at the top of the center of the transom. As an alternative, the brace can be mounted lower or a second brace could be mounted on an opposite of a motor mount.

Many alternate solutions can be provided. As examples, a brace can be provided that is formed of wood, plastic, metal, or any suitable material. Embodiments can utilize only one brace, or more than two braces. In addition, as opposed to being anchored to a bracket, a brace can be fully detached when the boat is not deployed, and attached at both ends, to the boat and to the folding transom, when the boat is deployed. In another embodiment, the brace can be hinged or otherwise connected to both the transom and the boat, and can be folded in with the boat. As another alternative, a brace can be rotatably or otherwise attached to the folding transom, and then selectively attached to a structure within the boat when the boat is deployed. In addition, as indicated above, the attachment of the brace to the folding transom can be positioned at any location on the folding transom remote from the hinge or other attachment of the folding transom to the boat. This attachment of the brace to the folding transom can be at a location that provides structure for the folding transom, such as in the embodiments shown in FIG. 36, or as a separate location for attachment on the folding transom.

Other variations are within the spirit of the present invention. Thus, while the invention is susceptible to various modifications and alternative constructions, certain illustrated embodiments thereof are shown in the drawings and have been described above in detail. It should be understood, however, that there is no intention to limit the invention to the specific form or forms disclosed, but on the contrary, the intention is to cover all modifications, alternative constructions, and equivalents falling within the spirit and scope of the invention, as defined in the appended claims.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. The term "connected" is to be construed as partly or wholly contained within, attached to, or joined together, even if there is something intervening. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate embodiments of the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

All references, including publications, patent applications, and patents, cited herein are hereby incorporated by reference to the same extent as if each reference were individually and specifically indicated to be incorporated by reference and were set forth in its entirety herein.

What is claimed is:

1. A boat comprising:

a collapsible hull having a first end and a second end, the hull comprising a plurality of panels extending between the first end and the second end, each of the panels being connected with at least one other of the panels, the hull configurable between a collapsed configuration and an expanded configuration;

a folding rigid transom to constrain at least two rear margins of the panels when the hull is in the expanded configuration, the folding rigid transom remaining attached to the hull when the hull is in the collapsed configuration;

a seat connected with the hull; and a brace removably attached to at least one of the rigid folding transom or the seat, the brace connected between and suspended between the seat and the folding rigid transom when the hull is in the expanded configuration such that the brace is supported independent of the plurality of panels.

2. The boat of claim 1, wherein the folding rigid transom has a first end and a second end, wherein the first end remains attached to the hull when the hull is in the collapsed configuration and the second end is attachable to the hull to secure the folding rigid transom while the folding rigid transom constrains the at least two rear margins of the panels, and wherein the brace connects to the seat and the folding rigid transom.

3. The boat of claim 1, wherein the folding rigid transom includes separate first and second sections, each of the first and second sections remaining attached to the hull when the hull is in the collapsed configuration, the first section being attachable to the second section to secure the folding rigid transom while the folding rigid transom constrains the at least two rear margins of the panels, and wherein the brace connects to the seat and the folding transom.

4. The boat of claim 3, wherein the brace comprises features that attach the first and second sections together while the folding rigid transom constrains the at least two rear margins of the panels.

5. The boat of claim 4, wherein each of the first and second sections includes an opening, and wherein the features comprise at least one tab that extends through the opening of each of the first and second sections while the folding rigid transom constrains the at least two rear margins of the panels.

6. The boat of claim 1, wherein the brace is rotatably mounted to the seat.

7. The boat of claim 6, wherein the seat is removably mounted within the hull.

8. A boat comprising:

a collapsible hull having a first end and a second end, the hull comprising a plurality of panels extending between the first end and the second end, each of the panels being connected with at least one other of the panels, the hull configurable between a collapsed configuration and an expanded configuration;

a folding rigid transom to constrain at least two rear margins of the panels when the hull is in the expanded configuration, the folding rigid transom remaining attached to the hull when the hull is in the collapsed configuration; and a brace connected between the hull and the folding rigid transom when the hull is in the expanded configuration;

wherein the brace is rotatively mounted to a floor of the hull.

9. The boat of claim 8, wherein the folding rigid transom has a first end and a second end, wherein the first end remains attached to the hull when the hull is in the collapsed configuration and the second end is attachable to the hull to secure the folding rigid transom while the folding rigid transom constrains the at least two rear margins of the panels.

10. The boat of claim 8, wherein the folding rigid transom includes separate first and second sections, each of the first and second sections remaining attached to the hull when the hull is in the collapsed configuration, the first section being attachable to the second section to secure the folding rigid transom while the folding rigid transom constrains the at least two rear margins of the panels.

11. The boat of claim 10, wherein the brace comprises features that attach the first and second sections together while the folding rigid transom constrains the at least two rear margins of the panels.

12. The boat of claim 11, wherein each of the first and second sections includes an opening, and wherein the features comprise at least one tab that extends through the opening of each of the first and second sections while the folding rigid transom constrains the at least two rear margins of the panels.

13. A boat comprising:

a collapsible hull having a first end and a second end, the hull comprising a plurality of panels extending between the first end and the second end, each of the panels being connected with at least one other of the panels, the hull configurable between a collapsed configuration and an expanded configuration;

a folding rigid transom to constrain at least two rear margins of the panels when the hull is in the expanded configuration, the folding rigid transom remaining attached to the hull when the hull is in the collapsed configuration; and a brace connected between the hull and the folding rigid transom when the hull is in the expanded configuration;

wherein the brace is rotatively mounted to a sidewall of the hull.

14. The boat of claim 13, wherein the folding rigid transom has a first end and a second end, wherein the first end remains attached to the hull when the hull is in the collapsed configuration and the second end is attachable to the hull to secure the folding rigid transom while the folding rigid transom constrains the at least two rear margins of the panels.

15. The boat of claim 13, wherein the folding rigid transom includes separate first and second sections, each of the first and second sections remaining attached to the hull when the hull is in the collapsed configuration, the first section being attachable to the second section to secure the folding rigid transom while the folding rigid transom constrains the at least two rear margins of the panels.

16. The boat of claim 15, wherein the brace comprises features that attach the first and second sections together while the folding rigid transom constrains the at least two rear margins of the panels.

17. The boat of claim 16, wherein each of the first and second sections includes an opening, and wherein the features comprise at least one tab that extends through the opening of each of the first and second sections while the folding rigid transom constrains the at least two rear margins of the panels.

18. A boat comprising:

a collapsible hull having a first end and a second end, the hull comprising a plurality of panels extending between the first end and the second end, each of the panels being connected with at least one other of the panels, the hull configurable between a collapsed configuration and an expanded configuration;

a folding rigid transom to constrain at least two rear margins of the panels when the hull is in the expanded configuration, the folding rigid transom remaining attached to the hull when the hull is in the collapsed configuration; and a brace connected between the hull and the folding rigid transom when the hull is in the expanded configuration; and wherein the brace comprises one or more vertically oriented retaining pins operable to prevent folding of the folding rigid transom when the folding rigid transom is constraining the at least two rear margins of the panels.

19. The boat of claim 18, wherein the one or more retaining pins are integrally formed into the brace.

20. The boat of claim 18, wherein the folding rigid transom comprises one or more slots configured to receive the one or more retaining pins extending there through, the one or more pins configurable to engage the folding rigid transom into the one or more slots to prevent folding of the folding rigid transom when the folding rigid transom is constraining the at least two rear margins of the panels.

21. The boat of claim 18, wherein the folding rigid transom has a first end and a second end, wherein the first end remains attached to the hull when the hull is in the collapsed configuration and the second end is attachable to the hull to secure the folding rigid transom while the folding rigid transom constrains the at least two rear margins of the panels.

22. The boat of claim 18, wherein the folding rigid transom includes separate first and second sections, each of the first and second sections remaining attached to the hull when the hull is in the collapsed configuration, the first section being attachable to the second section to secure the folding rigid transom while the folding rigid transom constrains the at least two rear margins of the panels.

23. The boat of claim 22, wherein at least one of the one or more vertically oriented retaining pins attach the first and second sections together while the folding rigid transom constrains the at least two rear margins of the panels.

24. The boat of claim 23, wherein each of the first and second sections includes an opening, and wherein the at least one of the one or more vertically oriented retaining pins extends through the opening of each of the first and second sections while the folding rigid transom constrains the at least two rear margins of the panels.

* * * * *